US011401634B2

(12) United States Patent
Smith

(10) Patent No.: US 11,401,634 B2
(45) Date of Patent: Aug. 2, 2022

(54) METHOD, APPARATUS, AND SYSTEM FOR MAKING STRING ART

(71) Applicant: Kenyon Smith, Boulder, CO (US)

(72) Inventor: Kenyon Smith, Boulder, CO (US)

( * ) Notice: Subject to any disclaimer, the term of this patent is extended or adjusted under 35 U.S.C. 154(b) by 0 days.

(21) Appl. No.: 16/834,709

(22) Filed: Mar. 30, 2020

(65) Prior Publication Data

US 2020/0308736 A1 Oct. 1, 2020

Related U.S. Application Data

(60) Provisional application No. 62/827,555, filed on Apr. 1, 2019.

(51) Int. Cl.
*D03D 29/00* (2006.01)
*D04G 5/00* (2006.01)
*D04G 3/02* (2006.01)

(52) U.S. Cl.
CPC ..... *D03D 29/00* (2013.01); *D04G 5/00* (2013.01)

(58) Field of Classification Search
CPC ..... D03D 29/00; D04G 5/00
See application file for complete search history.

(56) References Cited

U.S. PATENT DOCUMENTS 1,675,881 A * 7/1928 Denney ..... D03D 29/00 28/151
2,134,066 A * 10/1938 Van ..... D04B 39/00 66/4
2,146,991 A * 2/1939 Rowntree ..... D03C 13/00 139/91
2,159,265 A * 5/1939 Annie ..... D03D 29/00 139/34
2,186,692 A * 1/1940 Boyer ..... D03D 29/00 139/34
2,190,813 A * 2/1940 Kate ..... D03D 29/00 28/151
2,198,624 A * 4/1940 Kimson ..... D03D 29/00 139/33
2,199,515 A * 5/1940 Woods ..... D03D 29/00 139/34
2,382,048 A * 8/1945 Fox ..... D03D 29/00 139/34
2,424,880 A * 7/1947 Robertson ..... D03D 29/00 139/33
2,427,093 A * 9/1947 Eckert ..... D03D 29/00 28/152
2,463,365 A * 3/1949 Epstein ..... D03D 29/00 139/34
2,601,715 A * 7/1952 Simonds ..... D03D 29/00 28/152

(Continued)

OTHER PUBLICATIONS

Scale, (n.d.) American Heritage® Dictionary of the English Language, Fifth Edition. (2011). Retrieved Jun. 2, 2021 from https://www.thefreedictionary.com/scale (Year: 2011).*

*Primary Examiner* — Robert H Muromoto, Jr.
(74) *Attorney, Agent, or Firm* — Ditthavong, Steiner & Mlotkowski

(57) ABSTRACT

An apparatus for making string art. The apparatus comprising a base structure having a surface with a plurality of pre-formed protruding members arranged in a predetermined pattern. The plurality of pre-formed protruding members has a top end configured to hold a string.

20 Claims, 32 Drawing Sheets

(56) References Cited

U.S. PATENT DOCUMENTS 2,756,780 A * 7/1956 Epstein ..... D03D 29/00 139/30
2,780,854 A * 2/1957 Dritz ..... D03D 29/00 28/152
2,786,490 A * 3/1957 Epstein ..... D03D 29/00 139/33
3,032,071 A * 5/1962 Kokonoe ..... D03D 29/00 139/33
3,688,357 A * 9/1972 Nielsen ..... D03D 29/00 289/17
3,708,839 A * 1/1973 Prince ..... D03D 29/00 28/150
3,724,041 A * 4/1973 Cleverley ..... D04D 11/00 28/149
3,739,437 A * 6/1973 Alberici ..... D03D 29/00 28/151
3,776,280 A * 12/1973 Kliot ..... D03D 29/00 139/33
3,879,823 A * 4/1975 Lamb ..... D03D 29/00 28/147
3,971,417 A * 7/1976 Gentil ..... D03D 29/00 139/34
3,996,969 A * 12/1976 McCullough ..... D03D 29/00 139/29
4,046,172 A * 9/1977 Russell ..... D03D 29/00 139/33
4,072,173 A * 2/1978 Markowitz ..... D03D 29/00 139/34
4,074,726 A * 2/1978 Harris ..... D03D 29/00 139/29
4,077,436 A * 3/1978 Kliot ..... D03D 29/00 139/34
4,741,366 A * 5/1988 Yamotogi ..... D03D 29/00 139/34
4,832,085 A * 5/1989 Northrup ..... D03D 29/00 139/34
5,146,659 A * 9/1992 Spriggs, II ..... D03D 29/00 139/29
5,231,742 A * 8/1993 Macbain ..... D03D 29/00 139/34
5,284,186 A * 2/1994 Bontshek ..... D03D 29/00 139/34
5,413,150 A * 5/1995 Townsend ..... D03D 29/00 139/34
6,065,504 A * 5/2000 Sidore ..... D03D 29/00 139/29
6,834,682 B2 * 12/2004 Jenner ..... D03D 29/00 139/29
9,109,308 B2 * 8/2015 Wright ..... D03D 33/00
9,670,606 B2 * 6/2017 Wright ..... D03D 29/00
10,100,443 B2 * 10/2018 Wright ..... D03D 29/00
D895,690 S * 9/2020 Walker ..... D15/66
2007/0270010 A1 * 11/2007 Walter ..... D03D 29/00 439/259
2008/0223083 A1 * 9/2008 Gustin ..... D04B 5/00 66/1 A
2009/0123095 A1 * 5/2009 Welch ..... D04C 1/12 383/117
2009/0293982 A1 * 12/2009 Skaflestad ..... D04D 9/02 139/34
2010/0218840 A1 * 9/2010 Crorey ..... D04D 11/00 139/29
2011/0259465 A1 * 10/2011 Schaub ..... D04B 3/00 139/29
2014/0166150 A1 * 6/2014 Teramoto ..... D04D 1/04 139/29
2014/0373966 A1 * 12/2014 Nedry ..... D03D 29/00 139/29
2015/0129077 A1 * 5/2015 Wright ..... D03D 33/00 139/33
2015/0345051 A1 * 12/2015 Wright ..... D03D 33/00 139/33
2017/0233907 A1 * 8/2017 Wright ..... D03D 41/00 139/33
2021/0123169 A1 * 4/2021 Novak ..... D04B 3/00

* cited by examiner

METHOD, APPARATUS, AND SYSTEM FOR MAKING STRING ART

RELATED APPLICATION

This application claims priority of U.S. Provisional Patent Application Ser. No. 62/827,555, entitled "METHOD AND APPARATUS FOR MAKING STRING ART," filed on Apr. 1, 2019, the contents of which are hereby incorporated herein in their entirety by this reference.

BACKGROUND

Conventional string art involves inserting pins into a flat surface to delineate a pattern; thereafter strings are run from one specific pin to another specific pin tracing the pattern that will result in a specific design. The overall visual of string art is dependent on proper insertion and placement of the pins, e.g., straightly positioned, uniform depth, and consistent distance. However, correctly inserting and placing the pins depend on the type of pins and the composition of the surface; e.g., it is difficult for users to push pins into a hard surface. At times, these pins are not fully situated and become unstable. Furthermore, users find it challenging to maneuver strings around the pins to achieve the target design without guidance.

SOME EXAMPLE EMBODIMENTS

Therefore, there is a need for a method and system for forming a base structure comprising of peg-shaped members with string guiding capability.

Additional aspects and other features of the present disclosure will be set forth in the description which follows and in part will be apparent to those having ordinary skill in the art upon examination of the following or may be learned from the practice of the present disclosure. The advantages of the present disclosure may be realized and obtained as particularly pointed out in the appended claims.

According to the present disclosure, some technical effects may be achieved in part by an apparatus for making string art comprising: a base structure having a surface with a plurality of pre-formed protruding members arranged in a predetermined pattern, wherein each of the plurality of pre-formed protruding members has a top end configured to hold a string.

Another aspect of the apparatus includes the base structure comprising one or more connectors to receive another base structure. Other aspects include the one or more connectors are male connectors or female connectors. A further aspect includes the base structure comprising one or more in-built slots to house one or more magnets, and wherein the base structure is interlocked with the another base structure via the one or more magnets. Another aspect includes the plurality of pre-formed protruding members comprising a grooved shank. Other aspects include the plurality of pre-formed protruding members comprising markings for a string maneuver. A further aspect includes the base structure and the plurality of pre-formed protruding members comprising metallic materials, wooden materials, or plastic materials.

A further aspect of the present disclosure is system for making string art, comprising: a base structure having a surface with a plurality of holes, wherein the plurality of holes is arranged according to a predetermined pattern. Aspects of the system include a plurality of peg-shaped members configured to fit correspondingly within the plurality of holes, wherein each of the peg-shaped members has an end affixed with a fastening mechanism to secure the corresponding peg-shaped member into the associated one of the plurality of holes.

Another aspect of the system includes the base structure comprising one or more connectors to receive another base structure. Other aspects include the one or more connectors are male connectors or female connectors. A further aspect includes the base structure comprising one or more in-built slots to house one or more magnets, and wherein the base structure is interlocked with the another base structure via the one or more magnets. Another aspect includes the plurality of pre-formed protruding members comprising a grooved shank. Other aspects include the plurality of pre-formed protruding members comprising markings for a string maneuver. A further aspect includes the base structure and the plurality of pre-formed protruding members comprising metallic materials, wooden materials, or plastic materials.

A further aspect of the present disclosure is method of making a structure for string designs comprising: forming a base structure having a surface with a plurality of holes, wherein the plurality of holes is arranged according to a predetermined pattern. Aspects of the method include inserting a plurality of peg-shaped members within the plurality of holes, wherein each of the peg-shaped members has an end affixed with a fastening mechanism to secure the corresponding peg-shaped member into the associated one of the plurality of holes.

Another aspect of the method includes forming another base structure having another plurality of peg-shaped members, wherein the another base structure is configured to be affixed to the base structure. Other aspects include the fastening mechanism permitting the corresponding peg-shaped member to detach from the base structure. A further aspect includes the base structure comprising one or more connectors to receive another base structure, and wherein the one or more connectors are male connectors or female connectors. Another aspect includes the base structure comprising one or more in-built slots to house one or more magnets, and wherein the base structure is interlocked with the another base structure via the one or more magnets. Other aspects include plurality of peg-shaped members comprising a grooved shank.

Additional aspects and technical effects of the present disclosure will become readily apparent to those skilled in the art from the following detailed description wherein embodiments of the present disclosure are described simply by way of illustration of the best mode contemplated to carry out the present disclosure. As will be realized, the present disclosure is capable of other and different embodiments, and its several details are capable of modifications in various obvious respects, all without departing from the present disclosure. Accordingly, the drawings and description are to be regarded as illustrative in nature, and not as restrictive.

BRIEF DESCRIPTION OF THE DRAWINGS

The present disclosure is illustrated by way of example, and not by way of limitation, in the figures of the accompanying drawing and in which like reference numerals refer to similar elements and in which.

DETAILED DESCRIPTION

In the following description, for the purposes of explanation, numerous specific details are set forth in order to provide a thorough understanding of exemplary embodiments. It should be apparent, however, that exemplary embodiments may be practiced without these specific details or with an equivalent arrangement. In other instances, well-known structures and devices are shown in block diagram form in order to avoid unnecessarily obscuring exemplary embodiments. In addition, unless otherwise indicated, all numbers expressing quantities, ratios, and numerical properties of ingredients, reaction conditions, and so forth used in the specification and claims are to be understood as being modified in all instances by the term "about."

The present disclosure addresses and solves the current problems of improper pin insertion, inconsistent pin placement, and complicated thread maneuvering attendant upon a base structure comprising peg-shaped members with markings. The problems are solved, inter alia, by forming a base structure comprising a plurality of peg-shaped members with markings in a predetermined arrangement to achieve a predetermined design.

Still other aspects, features, and technical effects will be readily apparent to those skilled in this art from the following detailed description, wherein preferred embodiments are shown and described, simply by way of illustration of the best mode contemplated. The disclosure is capable of other and different embodiments, and its several details are capable of modifications in various obvious respects. Accordingly, the drawings and descriptions are to be regarded as illustrative in nature, and not as restrictive.

Figure 1A:
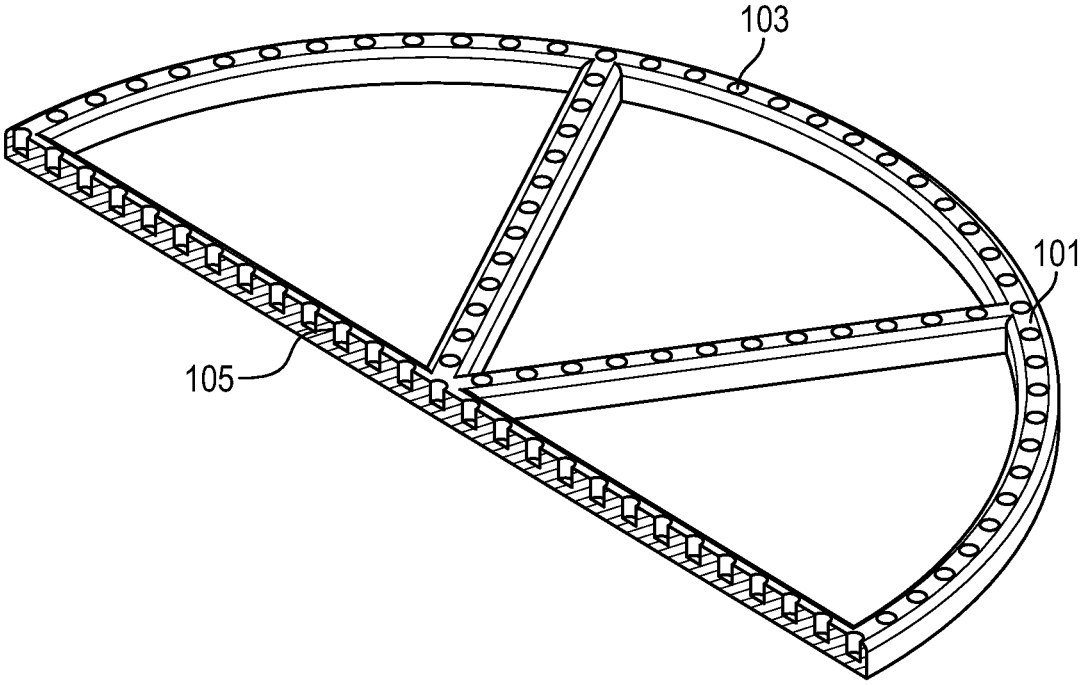
FIGS. 1 A-B are perspective views of a semi-circle structure for string art, according to one example embodiment.

FIGS. 1 A-B are perspective views of a semi-circle structure for string art, according to one example embodiment. Referring to FIG. 1A, an upper surface of semi-circle structure 101 comprises a plurality of holes 103/105 to receive a plurality of peg-shaped members. In one example embodiment, structure 101 may be an outline of any other shapes, e.g., geometric shapes, animal configurations, organic shapes, etc. The plurality of holes 103/105 are formed to a predetermined arrangement to achieve a predetermined design, and defines an inner diameter and inner depth to comfortably receive peg-shaped members. The plurality of holes 103/105 have uniform spacing between each other; alternatively, the spacing can follow a pattern of even and uneven spacing as to achieve various artistic designs with the strings. In one embodiment, semi-circle structure 101 may comprise highly flexible and resilient materials, e.g., plastic, rubber, or any fabric materials, to permit radial expansion of the plurality of holes 103/105 and receive the plurality of peg-shaped members of varying thickness. In another embodiment, semi-circle structure 101 may comprise wooden materials or metals (as well as any other solid materials, e.g., plastics, etc.), thereby providing a strong grip to peg-shaped members.

Figure 1B:
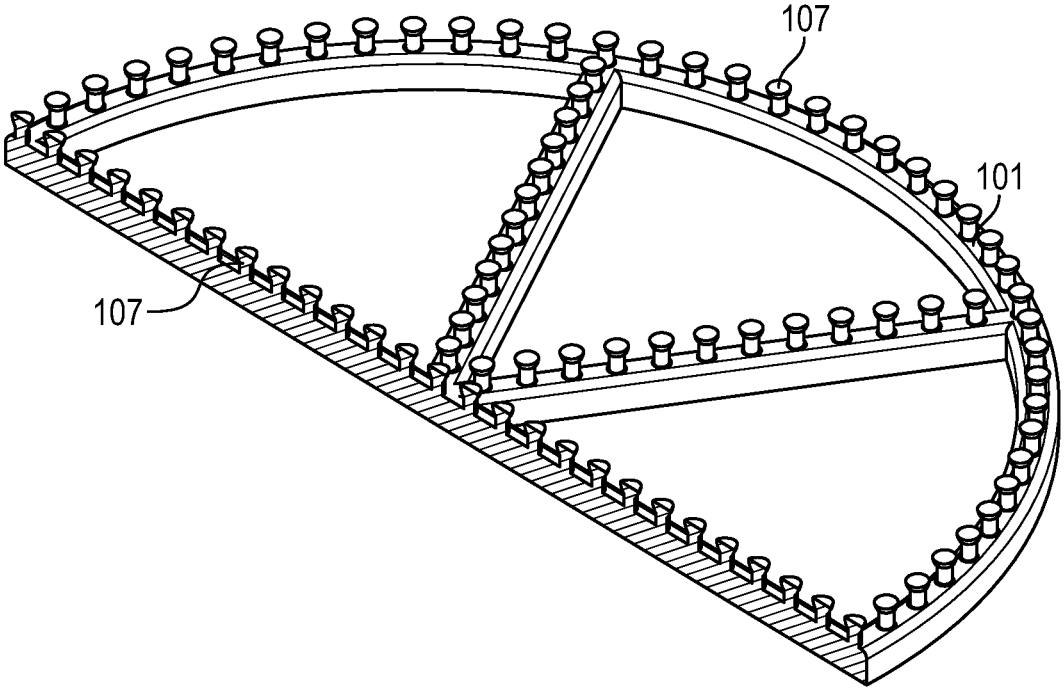

As depicted in FIG. 1B, peg-shaped members 107 are configured to fit correspondingly within the plurality of holes 103/105. The peg-shaped members 107 are formed to a predetermined thickness and a predetermined length based, at least in part, on attributes of the holes 103/105. In one embodiment, the peg-shaped members 107 comprises an end affixed with a fastening mechanism to secure itself to the holes 103/105. Furthermore, the fastening mechanism permits peg-shaped member 107 to detach from holes 103/105 and the base structure 101. In another embodiment, base structure 101 comprises a surface with a plurality of pre-formed protruding members, i.e., peg-shaped members 107 are in-built and fixed to the base structure 101 in a predetermined pattern to achieve a predetermined design. The plurality of pre-formed protruding members, i.e., the peg-shaped members 107, has a top end configured to hold a string. In one embodiment, the peg-shaped members 107 comprises a grooved shank for better grip. According to another embodiment, the peg-shaped members 107 can be formed in a non-coplanar arrangement.

Figure 2A:
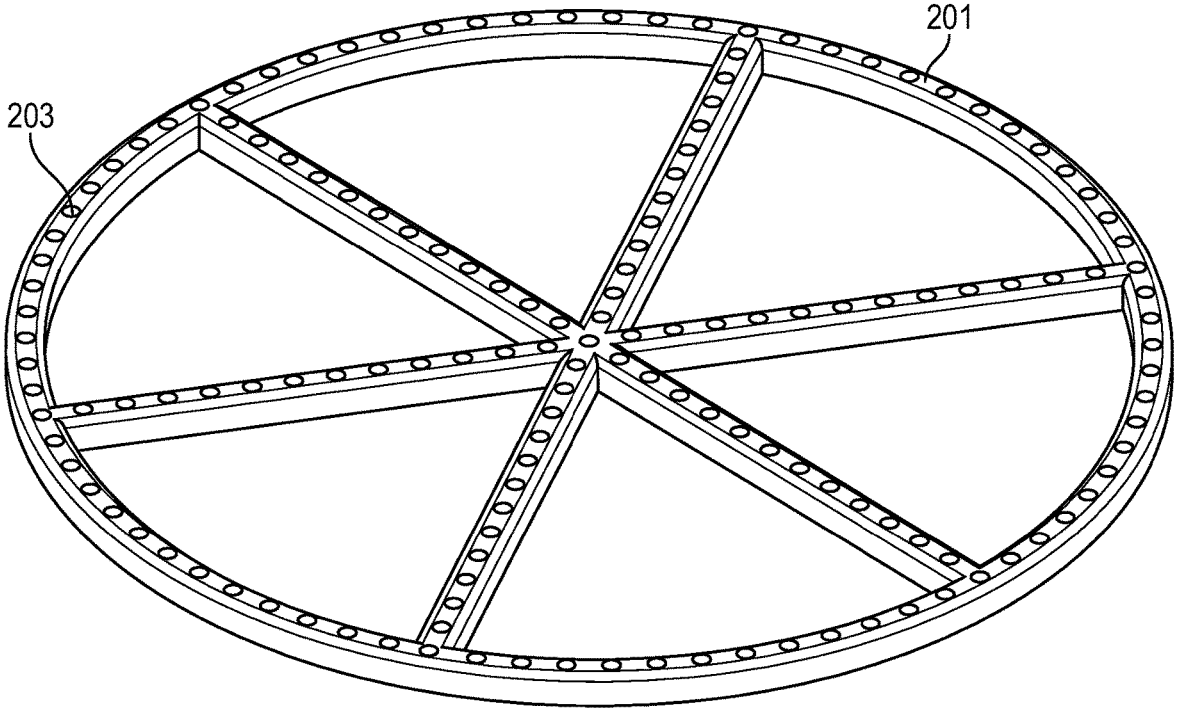
FIGS. 2 A-B are perspective views of a spherical structure for string art, according to one example embodiment.

FIGS. 2 A-B are perspective views of a spherical structure for string art, according to one example embodiment. Referring to FIG. 2A, an upper surface of spherical structure 201 comprises holes 203 to receive multiple peg-shaped members. The plurality of holes 203 is formed to a predetermined arrangement to achieve a predetermined design, and defines an inner diameter and inner depth to comfortably receive peg-shaped members. The plurality of holes 203 has uniform spacing between each other. In one embodiment, spherical structure 201 may comprise highly flexible and resilient materials, e.g., plastic, rubber, or any fabric materials, to permit radial expansion of the plurality of holes 203 to receive the plurality of peg-shaped members of varying thickness. In another embodiment, spherical structure 201 may comprise wooden materials or metals, thereby providing a strong grip to peg-shaped members.

Figure 2B:
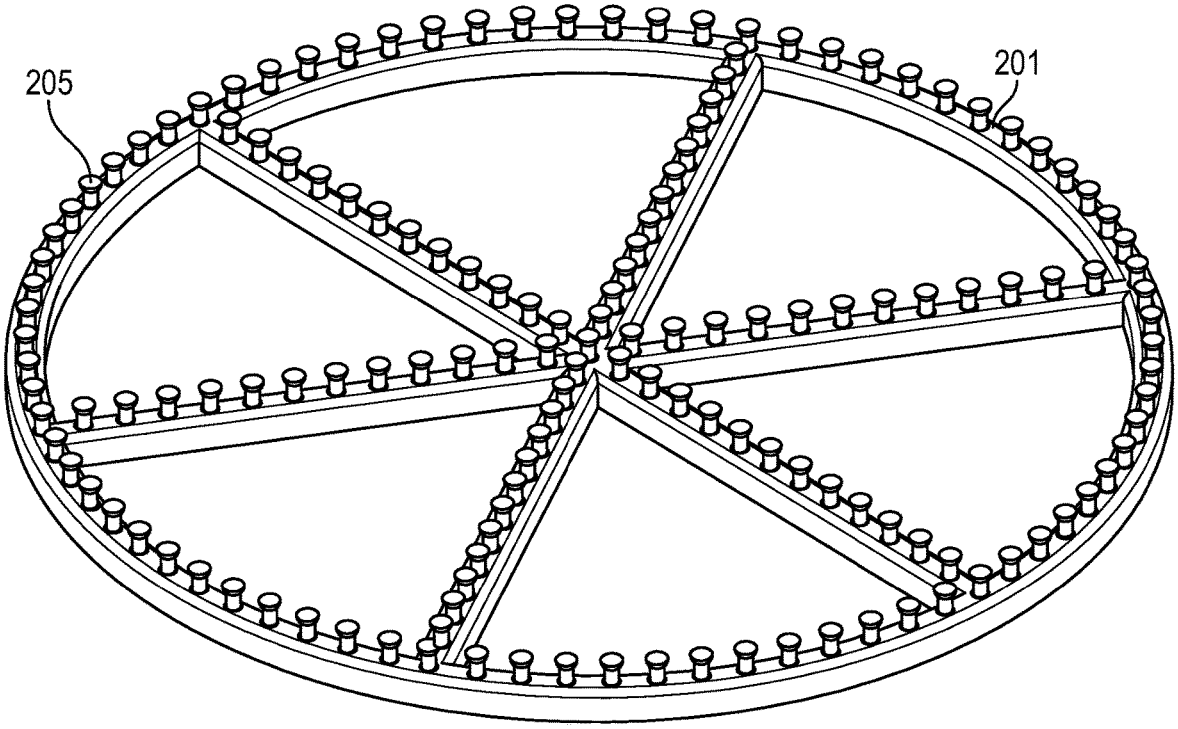

As represented in FIG. 2B, a plurality of peg-shaped members 205 are configured to fit correspondingly within the plurality of holes 203. In one embodiment, the plurality of peg-shaped members 205 is formed to a predetermined thickness and a predetermined length based, at least in part, on attributes of the plurality of holes 203. This plurality of peg-shaped members 205 comprises an end affixed with a fastening mechanism to secure itself to the holes 203. This fastening mechanism also permits the plurality of peg-shaped members 205 to detach from the plurality of holes 203 and the spherical structure 201. The peg-shaped members 205 comprises a top end configured to hold a string. In another embodiment, base structure 201 comprises a surface with a plurality of pre-formed protruding members, i.e., the plurality of peg-shaped members 205 is in-built and fixed to the base structure 201 in a predetermined arrangement to achieve a predetermined design. In a further embodiment, peg-shaped members 205 comprise markings for guiding users during string maneuvering. In one example embodiment, markings may include numbers, letters, or signs for users to run a string from one specific pin to another specific pin.

Figure 3A:
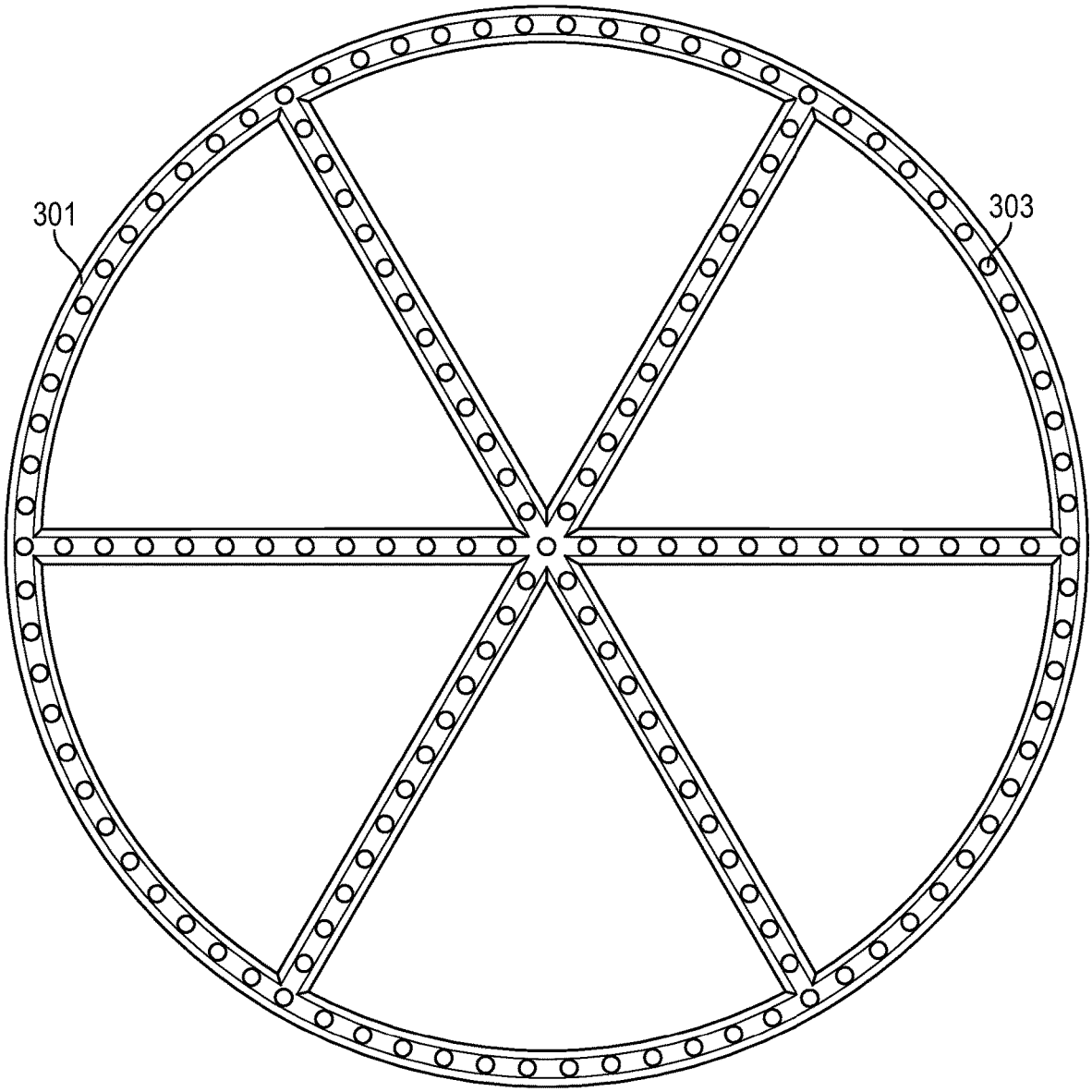
FIG. 3A is a front view of a spherical structure for string art, according to one example embodiment.

FIG. 3A is a front view of a spherical structure for string art, according to one example embodiment. As illustrated in FIG. 3A, the upper surface of spherical structure 301 comprises a plurality of holes 303 to receive a plurality of peg-shaped members. The plurality of holes 303 are evenly spaced and has uniform dimensions. In another embodiment, the plurality of holes 303 may vary in shapes, dimensions, and spacing per requirement. In one example embodiment, a plurality of holes 103/105 may accommodate screws, nails, or pegs.

Figure 3B:
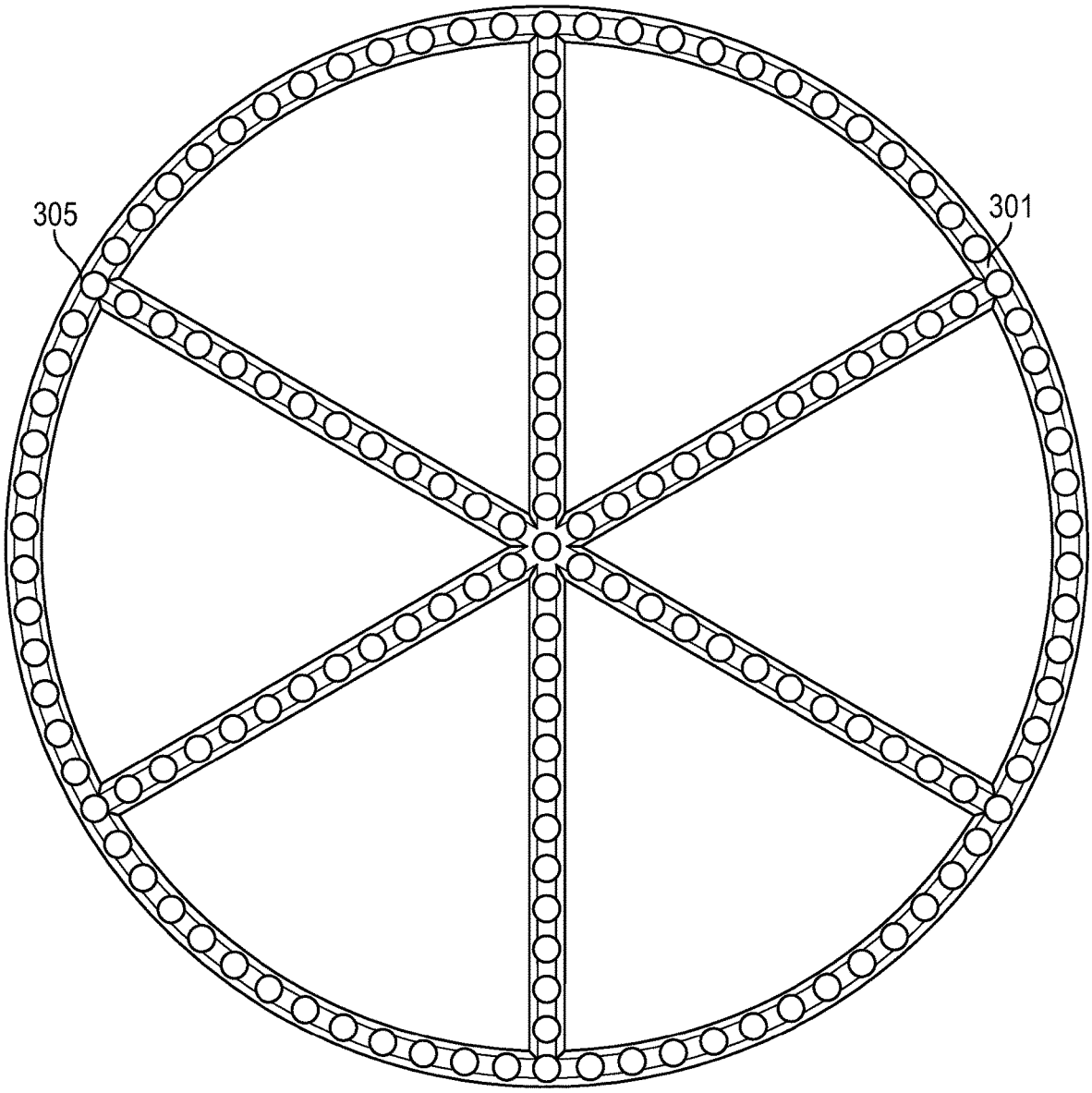
FIG. 3B is a front view of a spherical structure with peg-shaped members for string art, according to one example embodiment.

FIG. 3B is a front view of a spherical structure 301 with peg-shaped members 305 for string art, according to one example embodiment. In one embodiment, the back surface of spherical structure 301 comprises protrusions (not shown for illustrative convenience). The protrusions may comprise of plastic, rubber, or any fabric materials for better grip to the surface it is resting on. In another embodiment, the protrusion may house one or more magnets.

Figure 4A:
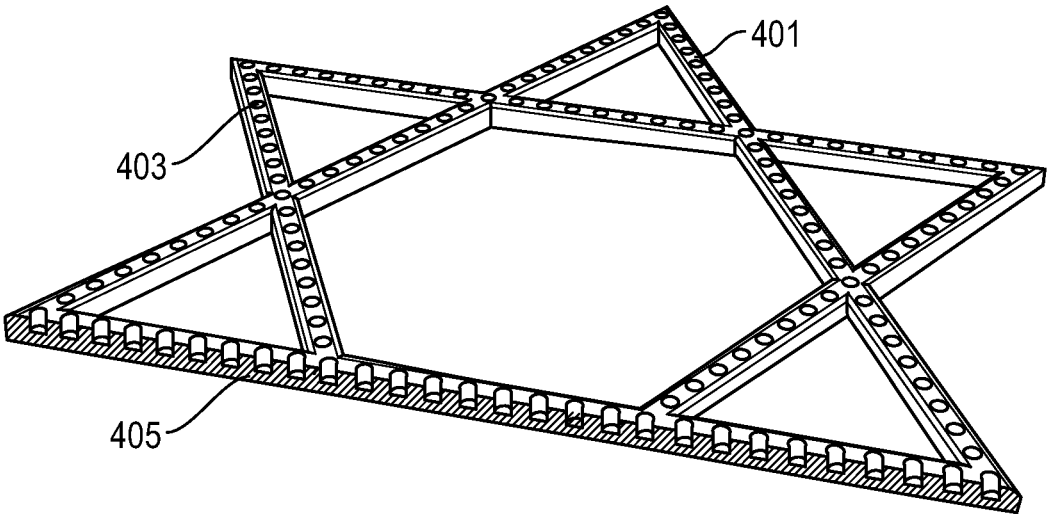
FIGS. 4 A-C are perspective views of a triangle-shaped structure for string art, according to one example embodiment.

FIGS. 4 A-C are perspective views of a triangle-shaped structure for string art, according to one example embodiment. As illustrated in FIG. 4A, the upper surface of triangle-shaped structure 401 comprises a plurality of holes 403 to receive a plurality of peg-shaped members. The plurality of holes 403 have uniform spacing between one another, however, the spacing may vary per requirement. In one embodiment, the plurality of holes 403 is circular, however, the shape may vary per requirement. As depicted in FIG. 4A, the plurality of holes 403 are either formed in the center portion of the frame or at the edges of the frame, e.g., the plurality of holes 403 are formed on the edges of sidewall 405.

Figure 4B:
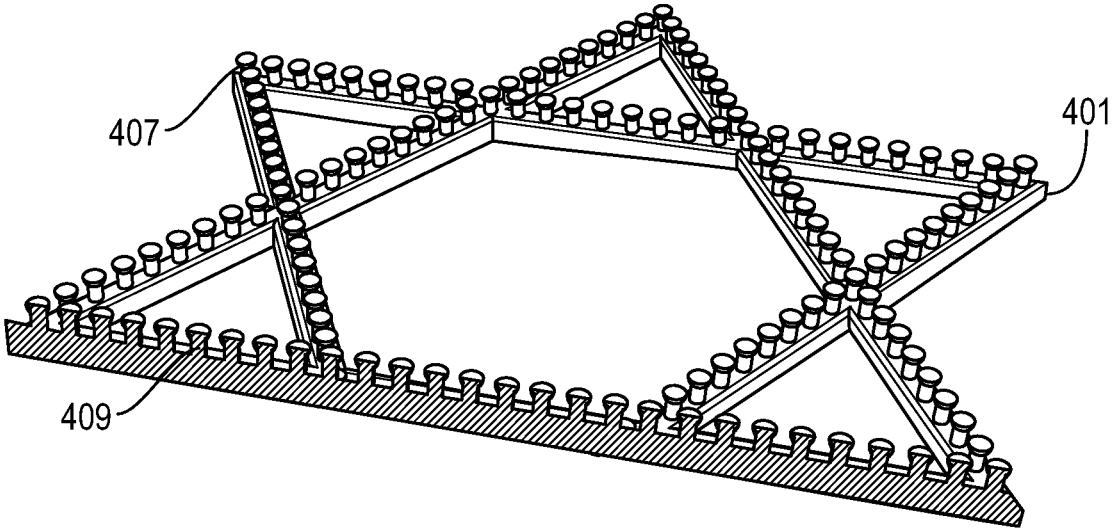

Adverting to FIG. 4B, a plurality of peg-shaped members 407 is inserted in the plurality of holes 403. The plurality of peg-shaped members 407 is formed to a predetermined thickness and a predetermined length based, at least in part, on attributes of the plurality of holes 403. The plurality of peg-shaped members 407 is detachable from the plurality of holes. In another embodiment, a plurality of peg-shaped members 409 is in-built and fixed to the triangle-shaped structure 401. In a further embodiment, the triangle-shaped structure 401 may comprise both detachable and fixed peg-shaped members.

Figure 4C:
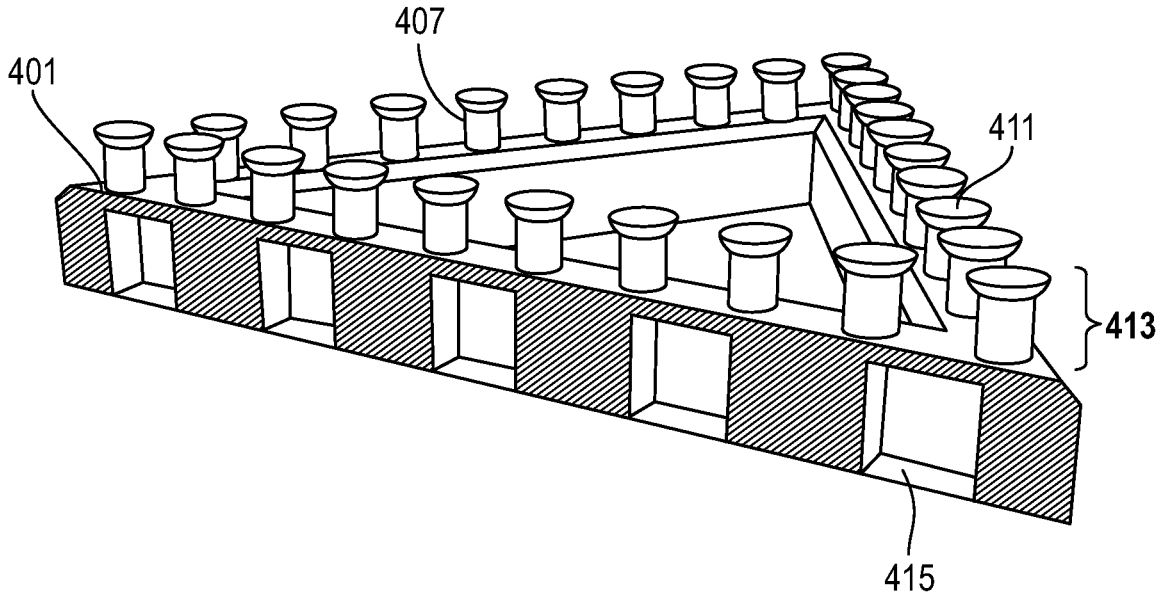

FIG. 4C is a magnified view of a portion of the triangle-shaped structure 401. As illustrated, the plurality of peg-shaped members 407 comprises an enlarged flat upper surface 411 for securing and preventing strings from slipping from the plurality of peg-shaped members 407. The dimensions of the enlarged flat upper surface 411 may vary per requirement. In one embodiment, the enlarged flat upper surface 411 may comprise markings (not shown for illustrative convenience) for string maneuver. In another embodiment, shank 413 of the plurality of peg-shaped members 407 may have a cylindrical shape, however, the shape may vary per requirement. The cylindrical shape comprises grooves on sidewall for better grip (not shown for illustrative convenience). In a further embodiment, the triangle-shaped structure 401 may comprise a plurality of trenches 415 on a sidewall of the triangle-shaped structure 401 to receive another base structure. In one example embodiment, base structures comprise built-in slots to house magnets to connect or interlock base structures.

Figure 5A:
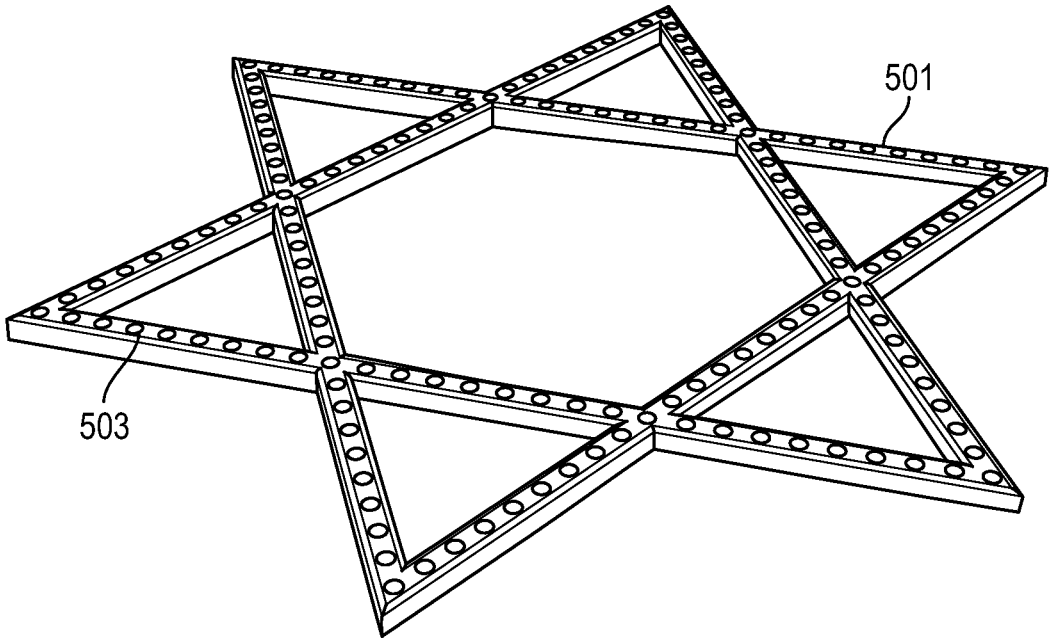
FIGS. 5 A-B are perspective views of a triangle-shaped structure for string art, according to one example embodiment.

FIGS. 5 A-B are perspective views of a triangle-shaped structure for string art, according to one example embodiment. As illustrated in FIG. 5A, the upper surface of triangle-shaped structure 501 comprises a plurality of holes 503 to receive a plurality of peg-shaped members. The plurality of holes 503 have uniform spacing between one another; however, the spacing may vary per requirement. In one embodiment, the plurality of holes 503 are circular, however, the shape may vary per requirement.

Figure 5B:
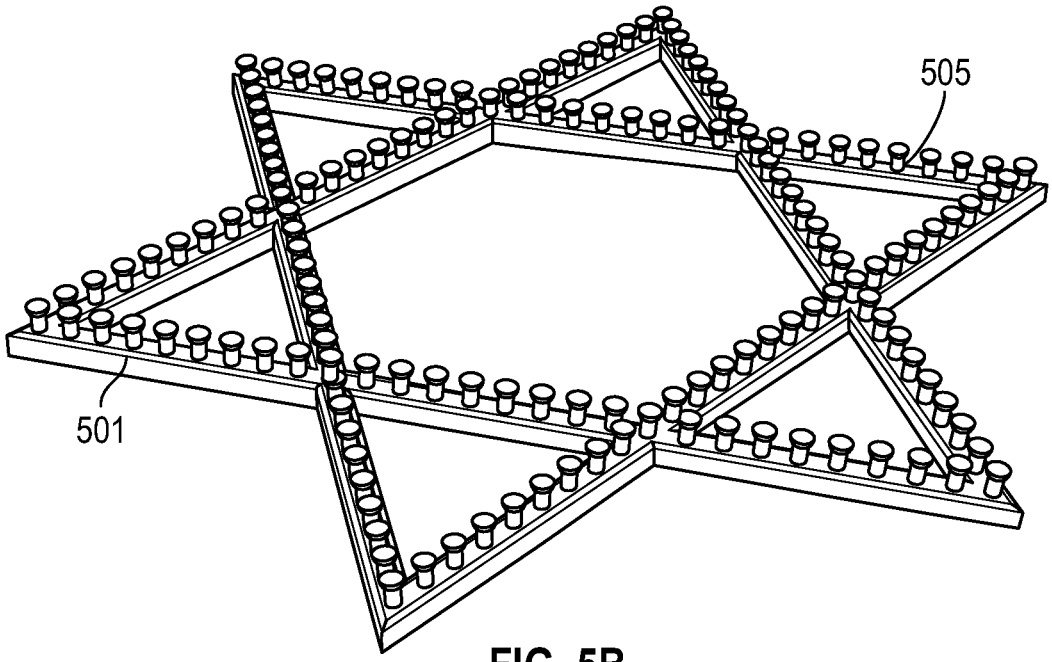

Adverting to FIG. 5B, a plurality of peg-shaped members 505 is inserted in the plurality of holes 503. The plurality of peg-shaped members 505 is formed to a predetermined thickness and a predetermined length based, at least in part, on attributes of the plurality of holes 503. The plurality of peg-shaped members 505 is detachable from the plurality of holes 503. In another embodiment, a plurality of peg-shaped members 505 is in-built and fixed to the triangle-shaped structure 501.

Figure 6A:
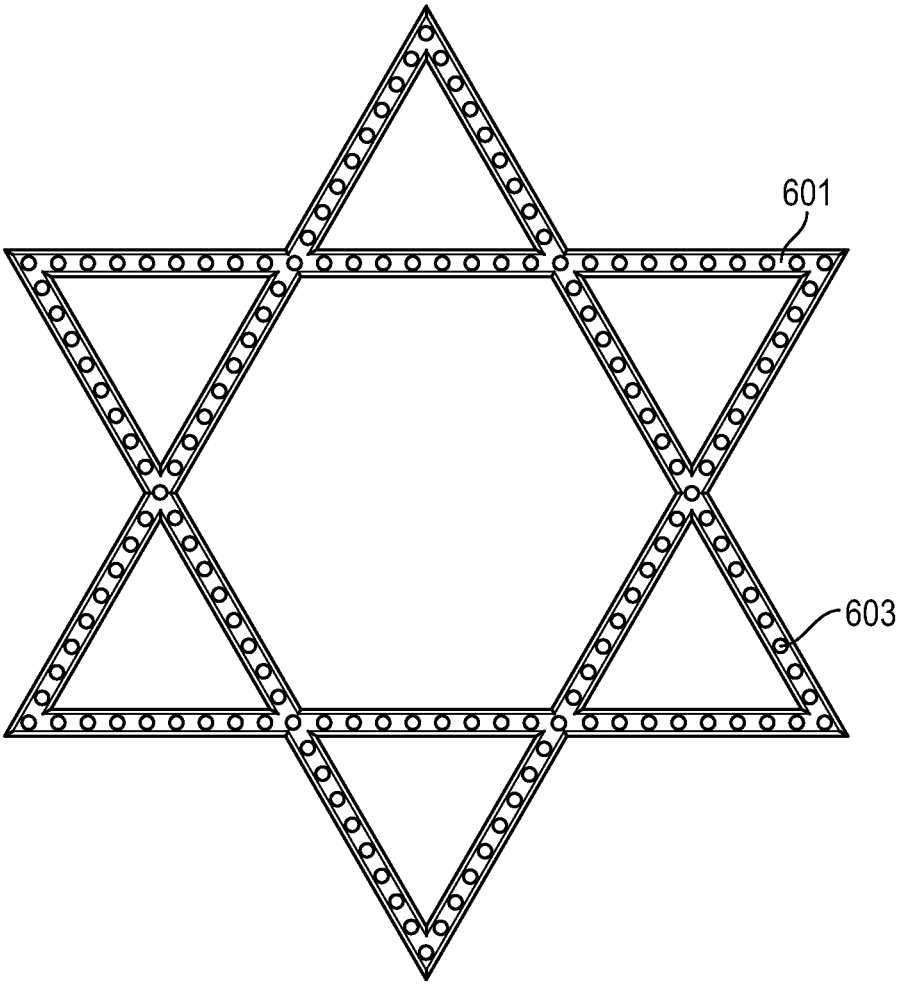
FIG. 6A is a front view of a triangle-shaped structure for string art, according to one example embodiment.

FIG. 6A is a front view of a triangle-shaped structure for string art, according to one example embodiment. As illustrated in FIG. 6A, the upper surface of triangle structure 601 comprises a plurality of holes 603 to receive a plurality of peg-shaped members. The plurality of holes 603 are evenly spaced and has uniform dimensions. In another embodiment, the plurality of holes 603 may vary in shapes, dimensions, and spacing per requirement.

Figure 6B:
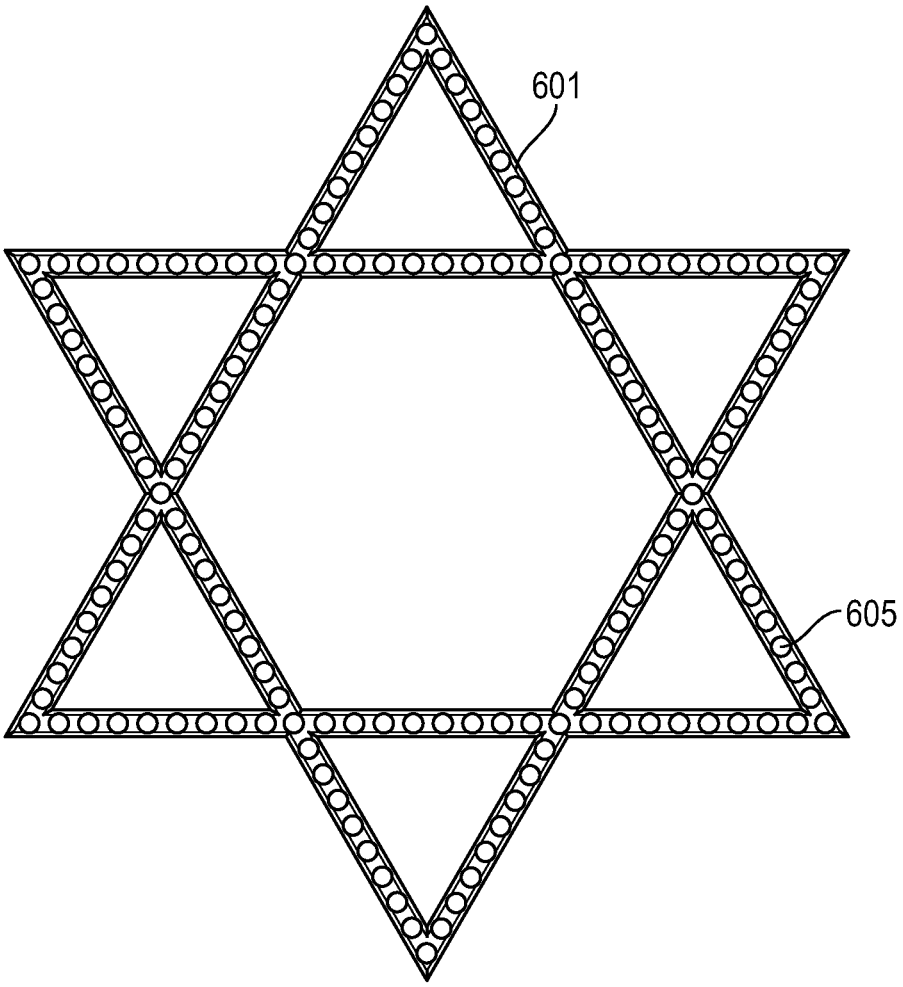
FIG. 6B is a front view of a triangle-shaped structure with peg-shaped members for string art, according to one example embodiment.

FIG. 6B is a front view of a triangle-shaped structure 601 with peg-shaped members 605 for string art, according to one example embodiment. In one embodiment, the back surface of triangle-shaped structure 601 comprises protrusions (not shown for illustrative convenience). The protrusions may comprise of plastic, rubber, or any fabric materials for better grip to the surface it is resting on. In another embodiment, the protrusion may house one or more magnets.

Figure 7A:
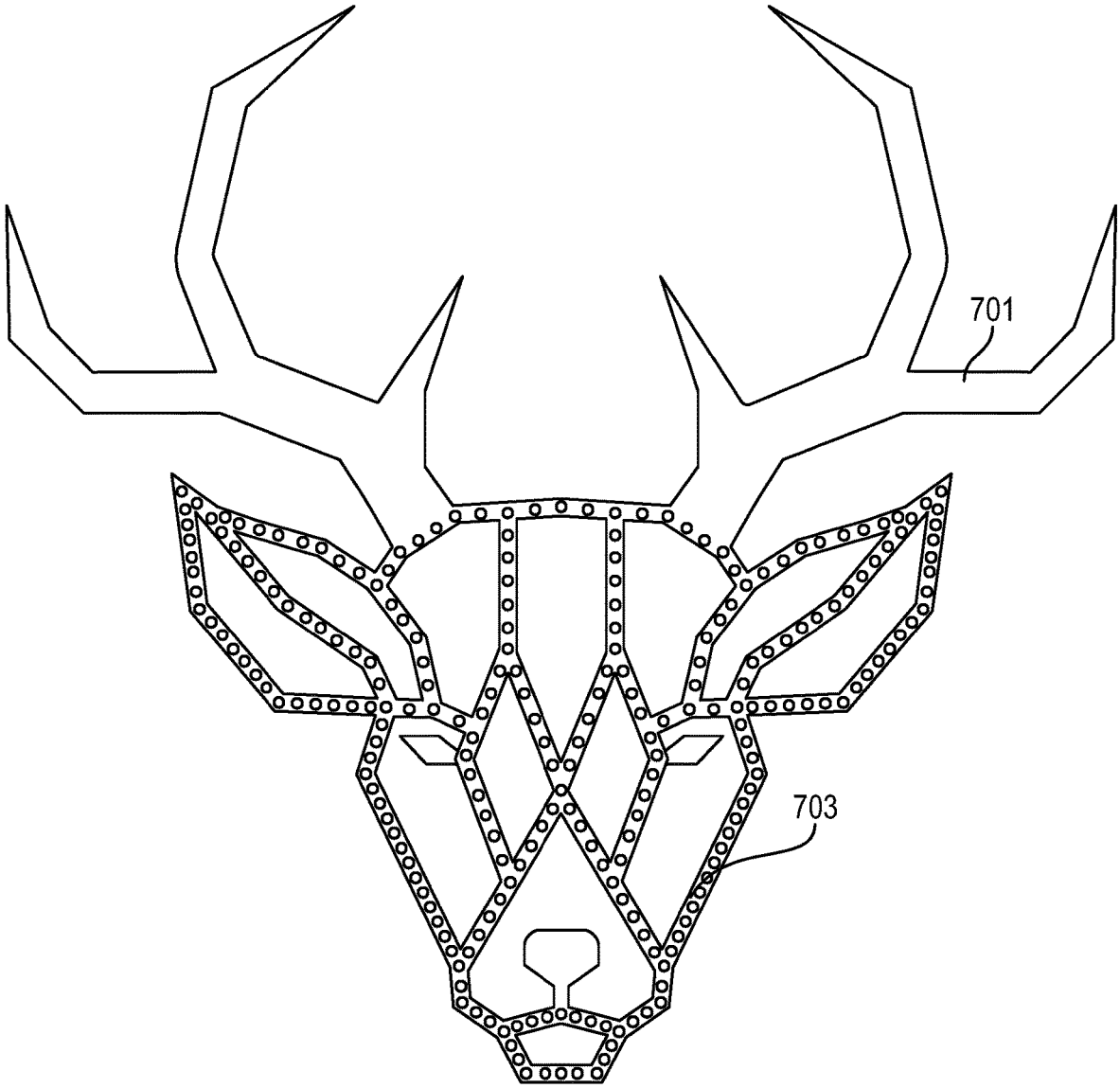
FIG. 7A is a front view of a design for string art in an animal configuration, according to one example embodiment.

FIG. 7A is a front view of a design for string art in an animal configuration, according to one example embodiment. As illustrated in FIG. 7A, a portion of the surface of design 701 comprises a plurality of holes 703 to receive a plurality of peg-shaped members. The plurality of holes 703 are evenly spaced and has uniform dimensions. In another embodiment, the plurality of holes 703 may vary in shapes, dimensions, and spacing per requirement.

Figure 7B:
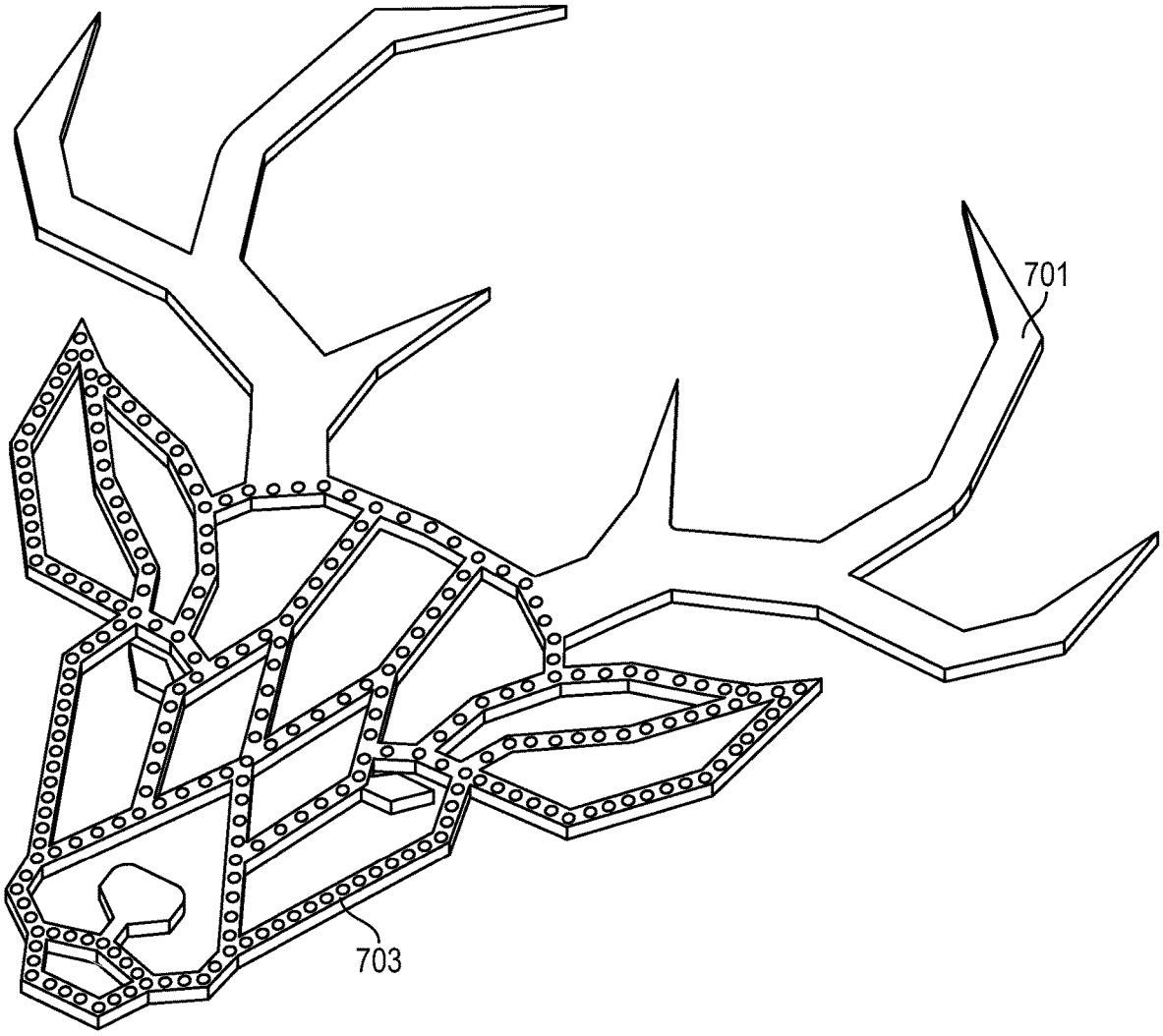
FIG. 7B is a perspective view of a design for string art in an animal configuration, according to one example embodiment.

FIG. 7B is a perspective view of a design for string art in an animal configuration, according to one example embodiment.

Figure 8A:
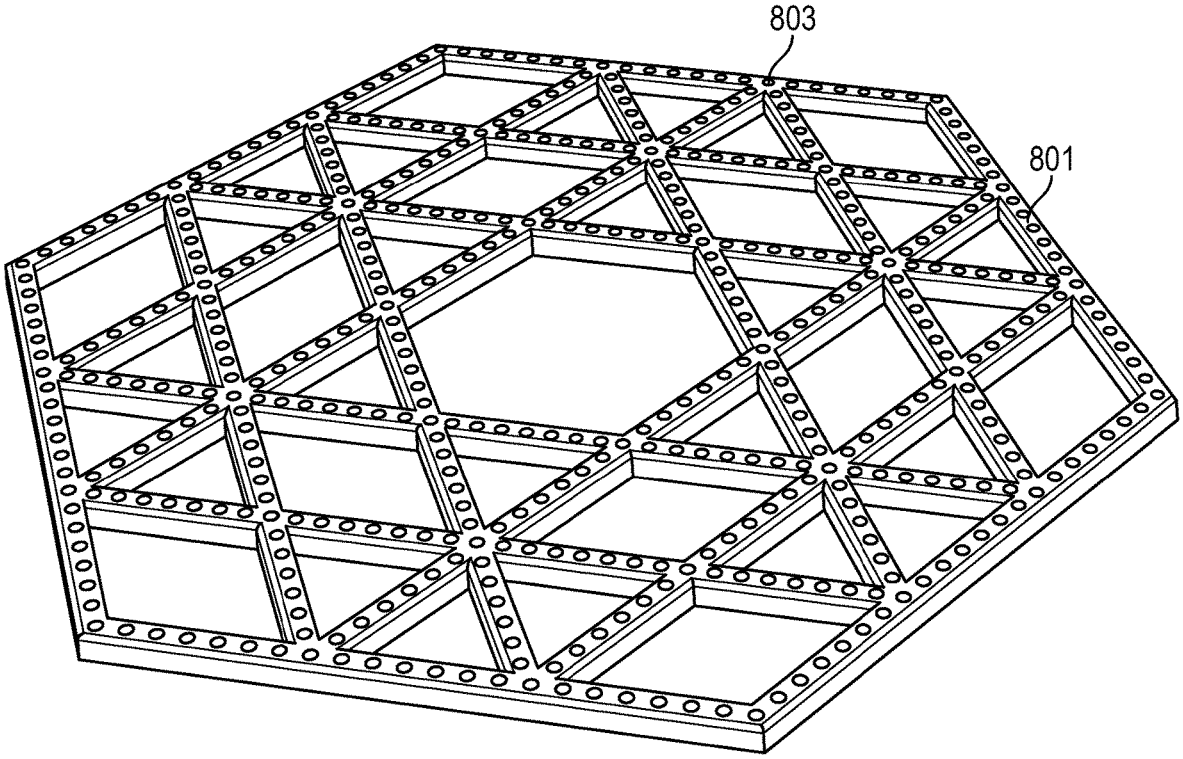
FIG. 8A is a front perspective view of a hexagon-shaped structure for string art, according to one example embodiment.

FIG. 8A is a front perspective view of a hexagon-shaped structure for string art, according to one example embodiment. As illustrated in FIG. 8A, the surface of hexagon-shaped structure 801 comprises a plurality of holes 803 to receive a plurality of peg-shaped members. The plurality of holes 803 are evenly spaced and has uniform dimensions. In another embodiment, the plurality of holes 803 may vary in shapes, dimensions, and spacing per requirement.

Figure 8B:
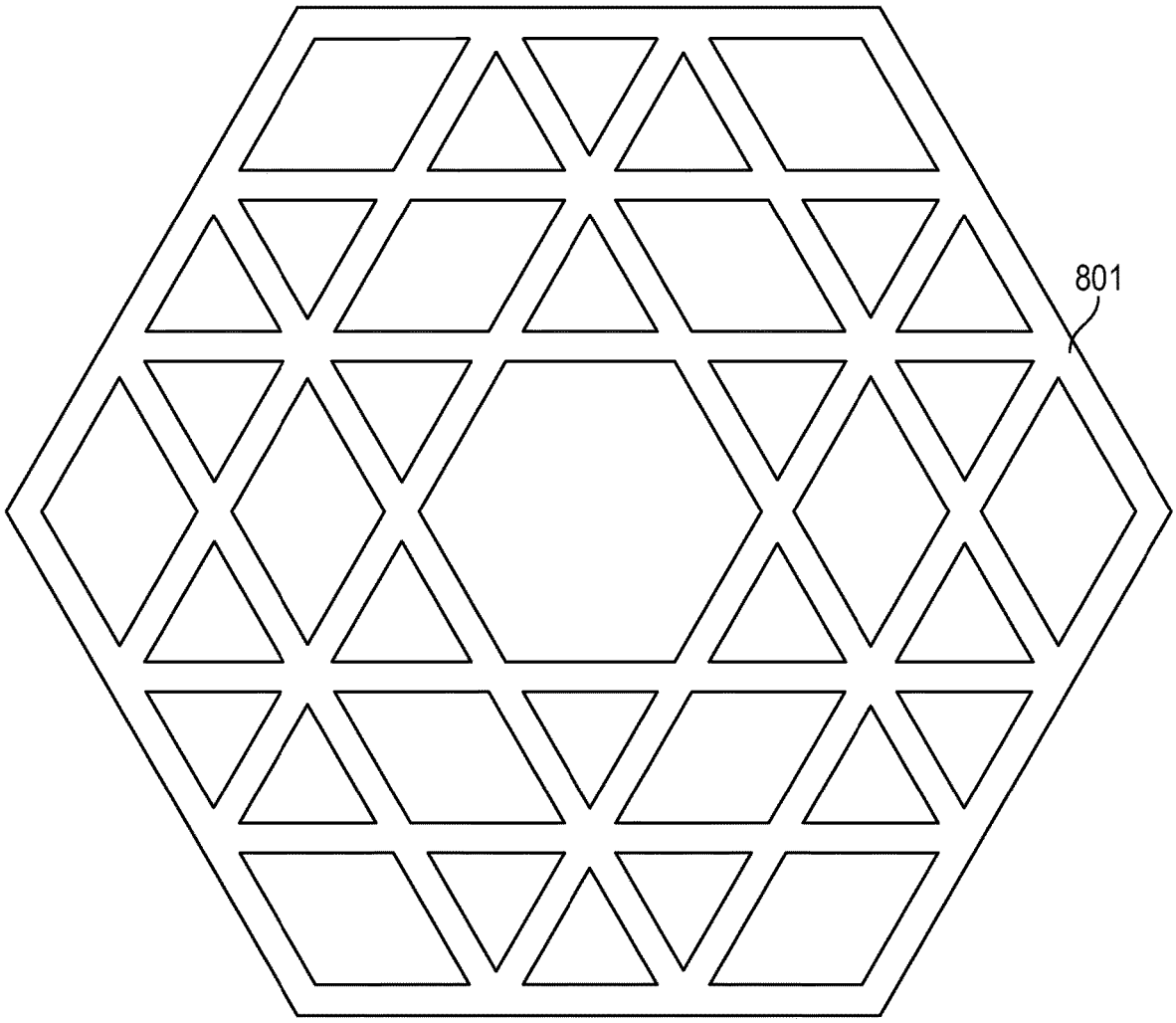
FIG. 8B is a back view of a hexagon-shaped structure for string art, according to one example embodiment.

FIG. 8B is a back view of a hexagon-shaped structure for string art, according to one example embodiment. As depicted, hexagon-shaped structure 801 has a smooth bottom surface for proper positioning on any surface it is resting on.

Figure 9A:
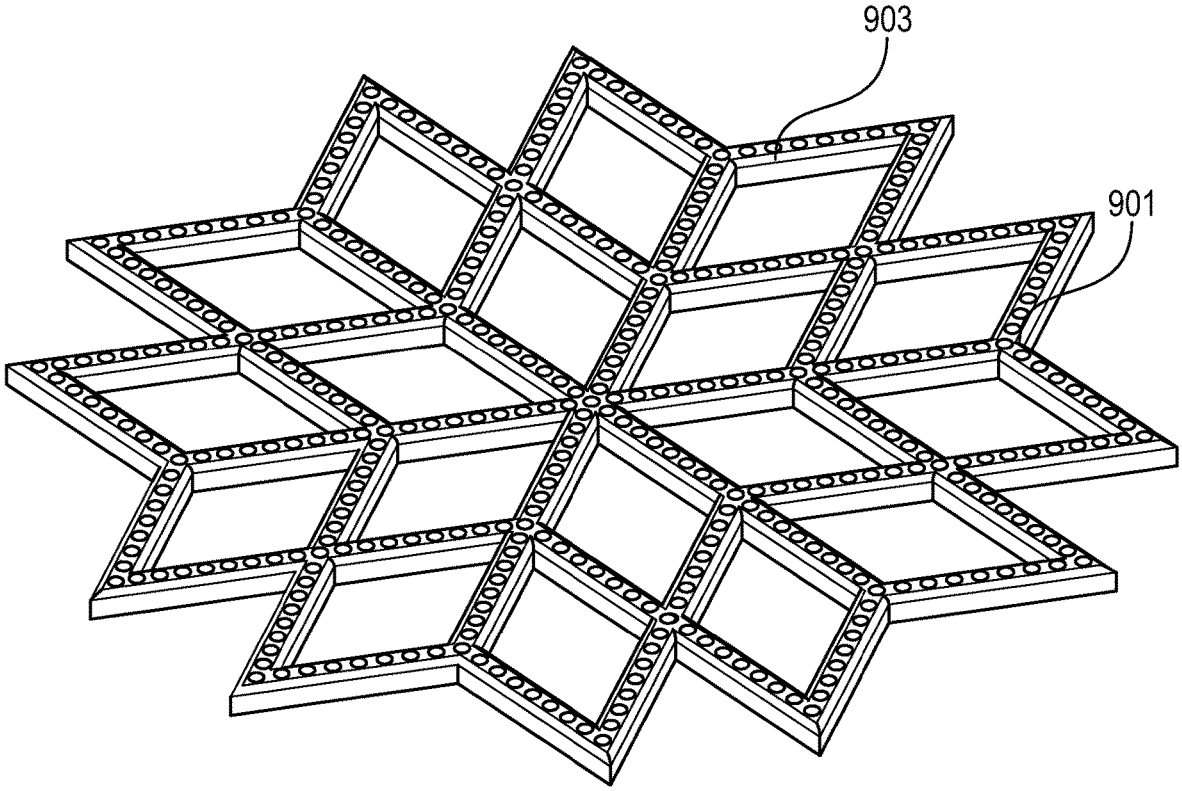
FIG. 9A is a front view of an organic design for string art, according to one example embodiment.

FIG. 9A is a front view of an organic design for string art, according to one example embodiment. As illustrated in FIG. 9A, the surface of structure 901 comprises a plurality of holes 903 to receive a plurality of peg-shaped members. The plurality of holes 903 are evenly spaced and has uniform dimensions. In another embodiment, the plurality of holes 903 may vary in shapes, dimensions, and spacing per requirement.

Figure 9B:
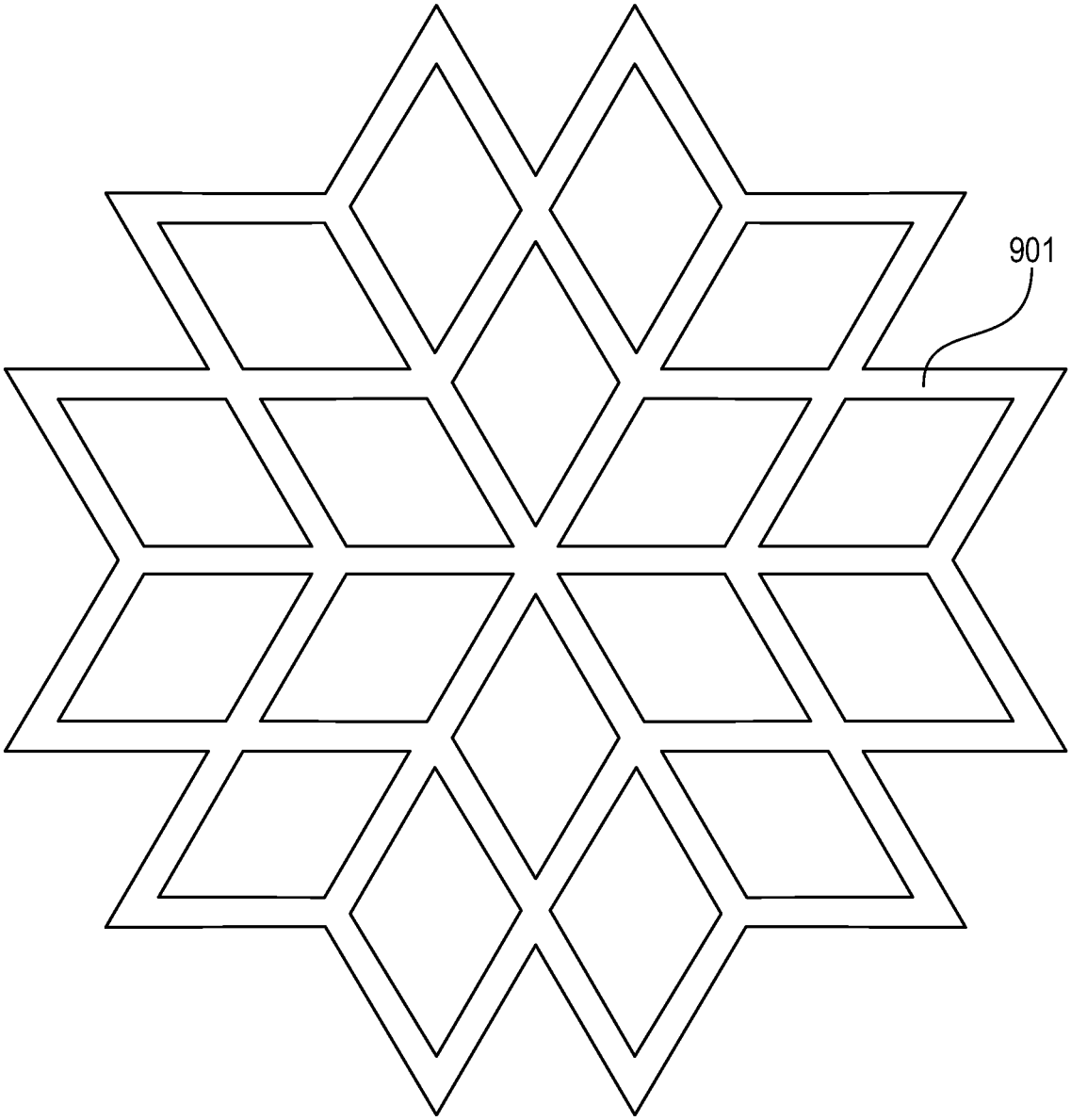
FIG. 9B is a back view of an organic design for string art, according to one example embodiment.

FIG. 9B is a back view of an organic design for string art, according to one example embodiment. As depicted, structure 901 has a smooth bottom surface for proper positioning on any surface it is resting on.

Figure 10A:
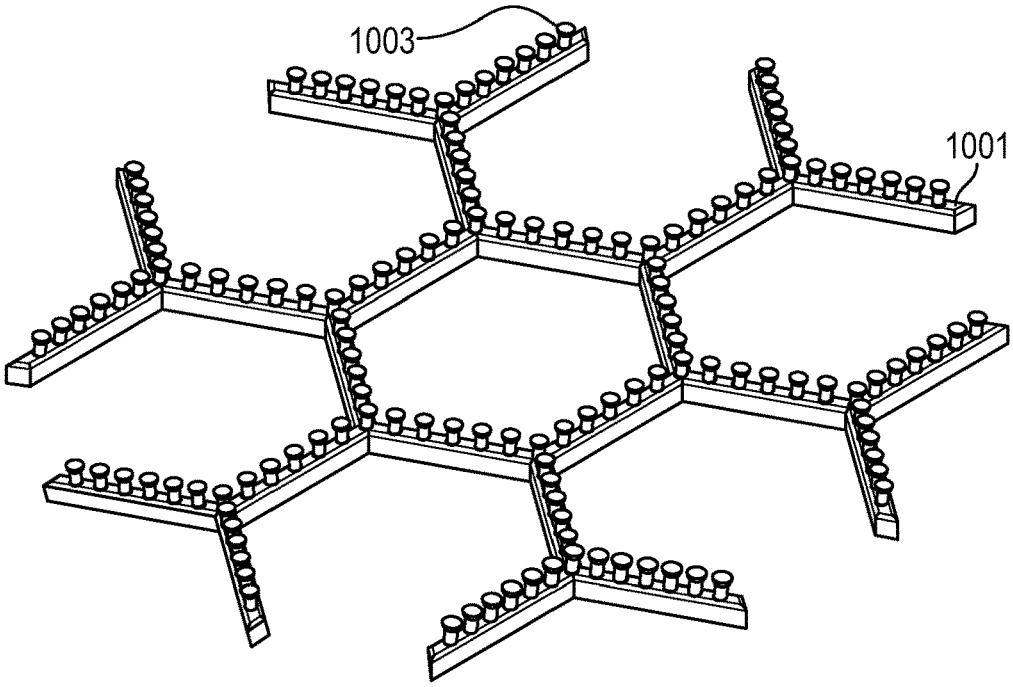
FIG. 10A is a front view of an organic design for string art, according to one example embodiment.

FIG. 10A is a front view of an organic design for string art, according to one example embodiment. As illustrated in FIG. 10A, the upper surface of structure 1001 comprises a plurality of peg-shaped members 1003 formed to a predetermined thickness and a predetermined length. The plurality of peg-shaped members 1003 is in-built and fixed to structure 1001. In another embodiment, the plurality of peg-shaped members 1003 is detachable from structure 1001.

Figure 10B:
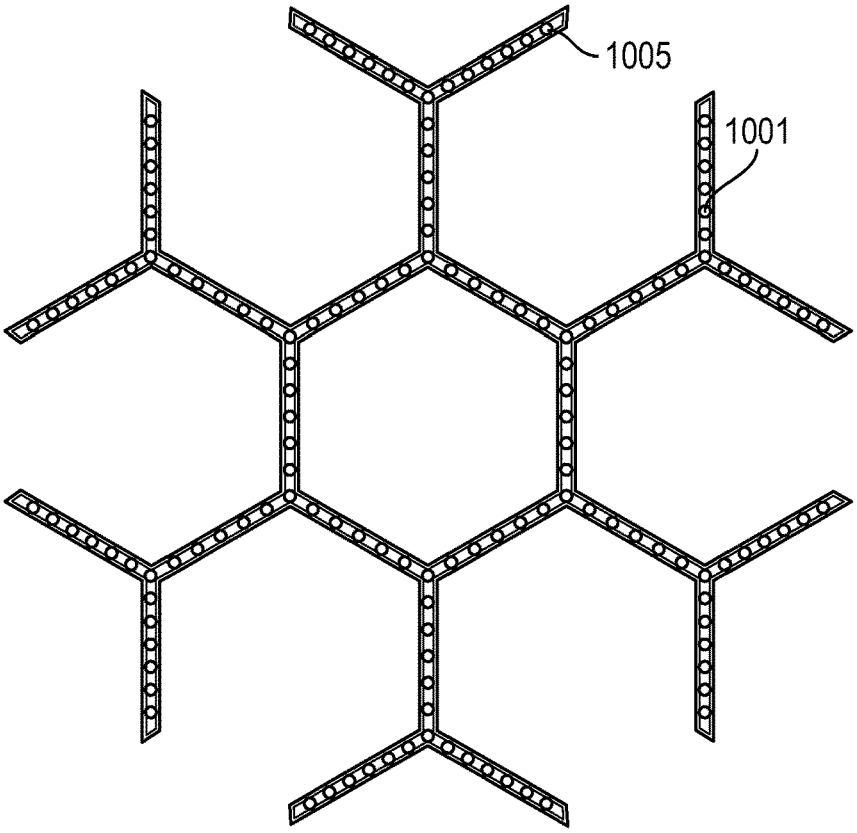
FIG. 10B is a front view of an organic design with peg-shaped members for string art, according to one example embodiment.

FIG. 10B is a front view of an organic design 1001 with peg-shaped members 1005 for string art, according to one example embodiment. In one embodiment, the back surface of structure 1001 comprises protrusions (not shown for illustrative convenience). The protrusions may comprise of plastic, rubber, or any fabric materials for better grip to the surface it is resting on. In another embodiment, the protrusion may house magnets.

Figure 11A:
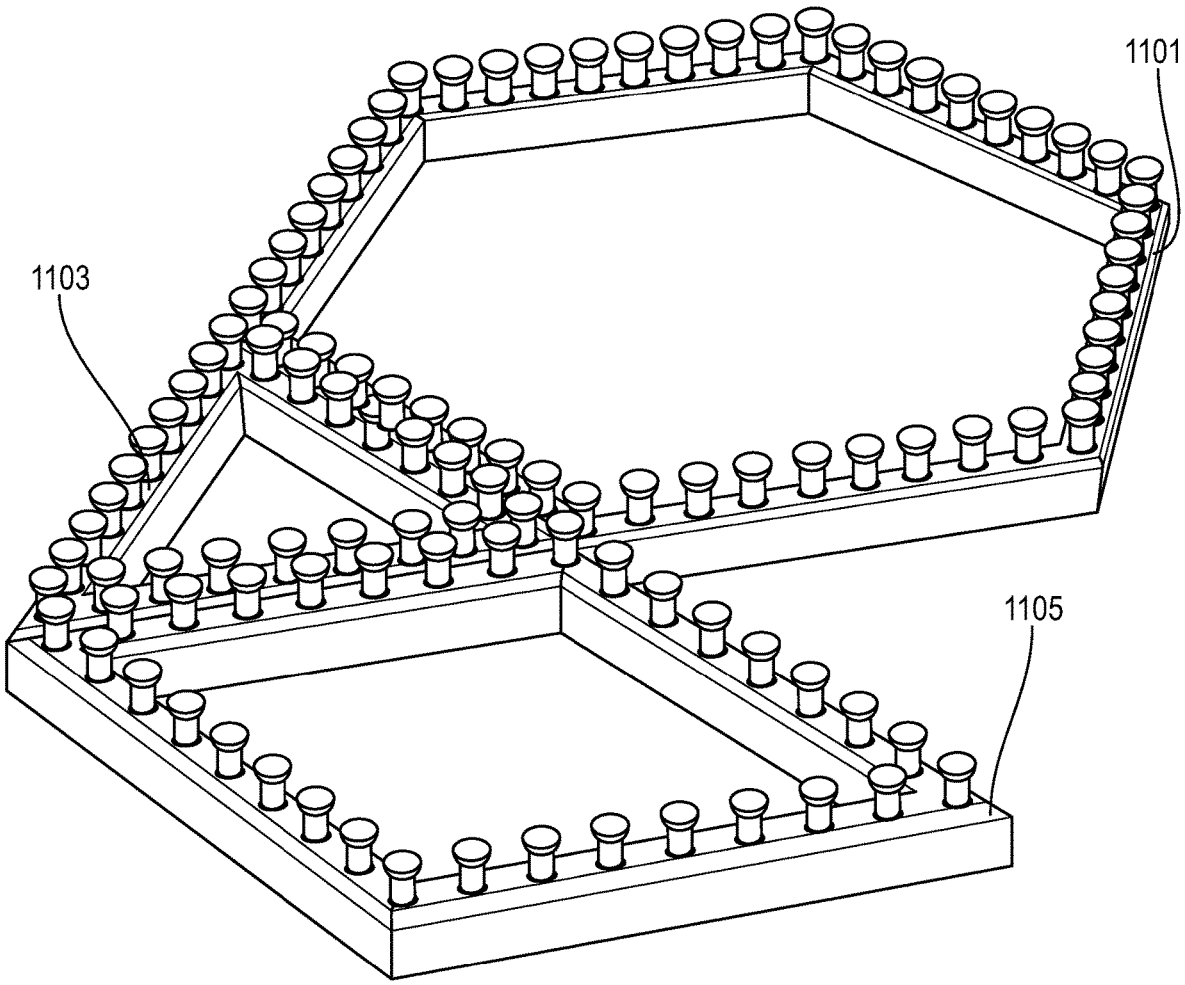
FIGS. 11 A-B illustrate one or more structures for string art interlocked via magnets, according to one example embodiment.

FIG. 11 A-B illustrates one or more structures for string art interlocked via magnets, according to one example embodiment. As illustrated in FIG. 11A, hexagonal structure 1101, triangular structure 1103, and rectangular structure 1105 are interlocked by magnets (not shown for illustrative convenience) housed in the in-built slots of the respective structures.

Figure 11B:
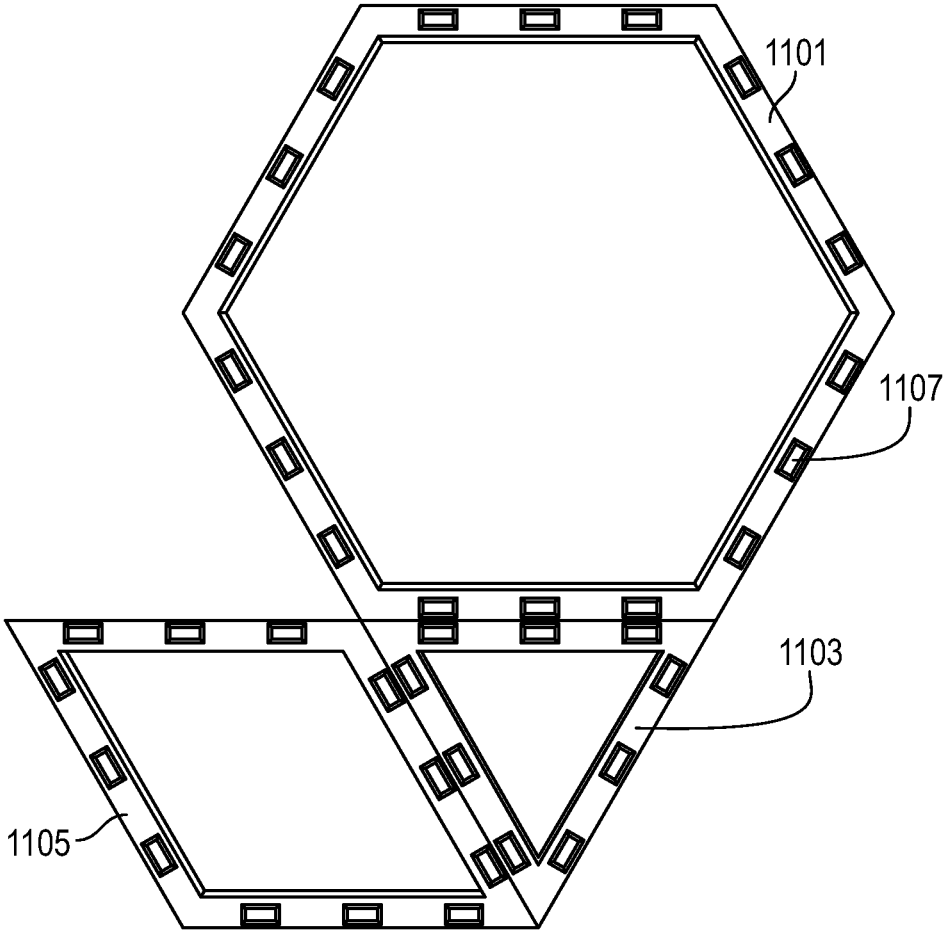

FIG. 11B is a back view of an organic design for string art, according to one example embodiment. As shown, the back surface of hexagonal structure 1101, triangular structure 1103, and rectangular structure 1105 comprises a plurality of trenches 1107 that houses the magnets (not shown for illustrative convenience).

Figure 12:
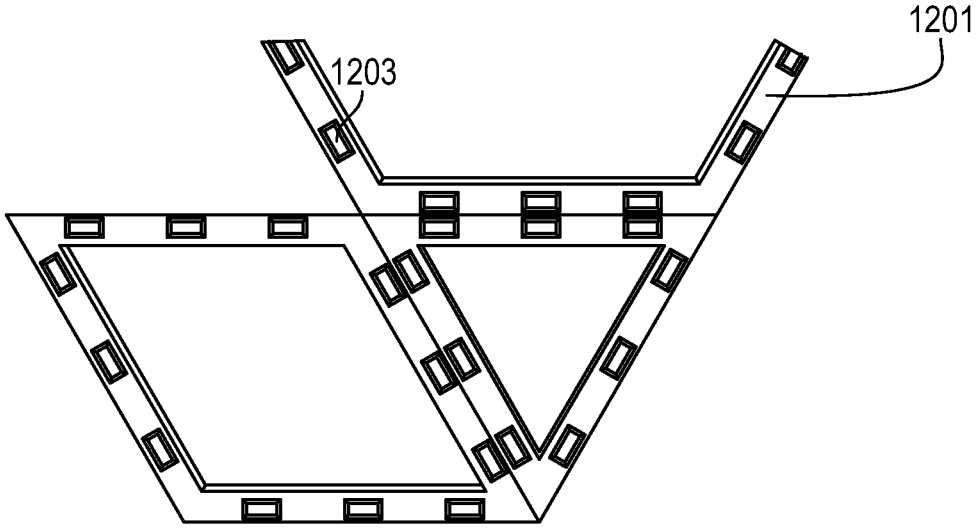
FIG. 12 is a back view of a structure with in-built slots to house magnets, according to one example embodiment.

FIG. 12 is a back view of a structure with in-built slots to house magnets, according to one example embodiment. As depicted, the back surface of structure 1201 comprises a plurality of trenches 1203 that houses the magnets. In one example embodiment, the magnets may be used for connecting a plurality of base structures or frames.

Figure 13A:
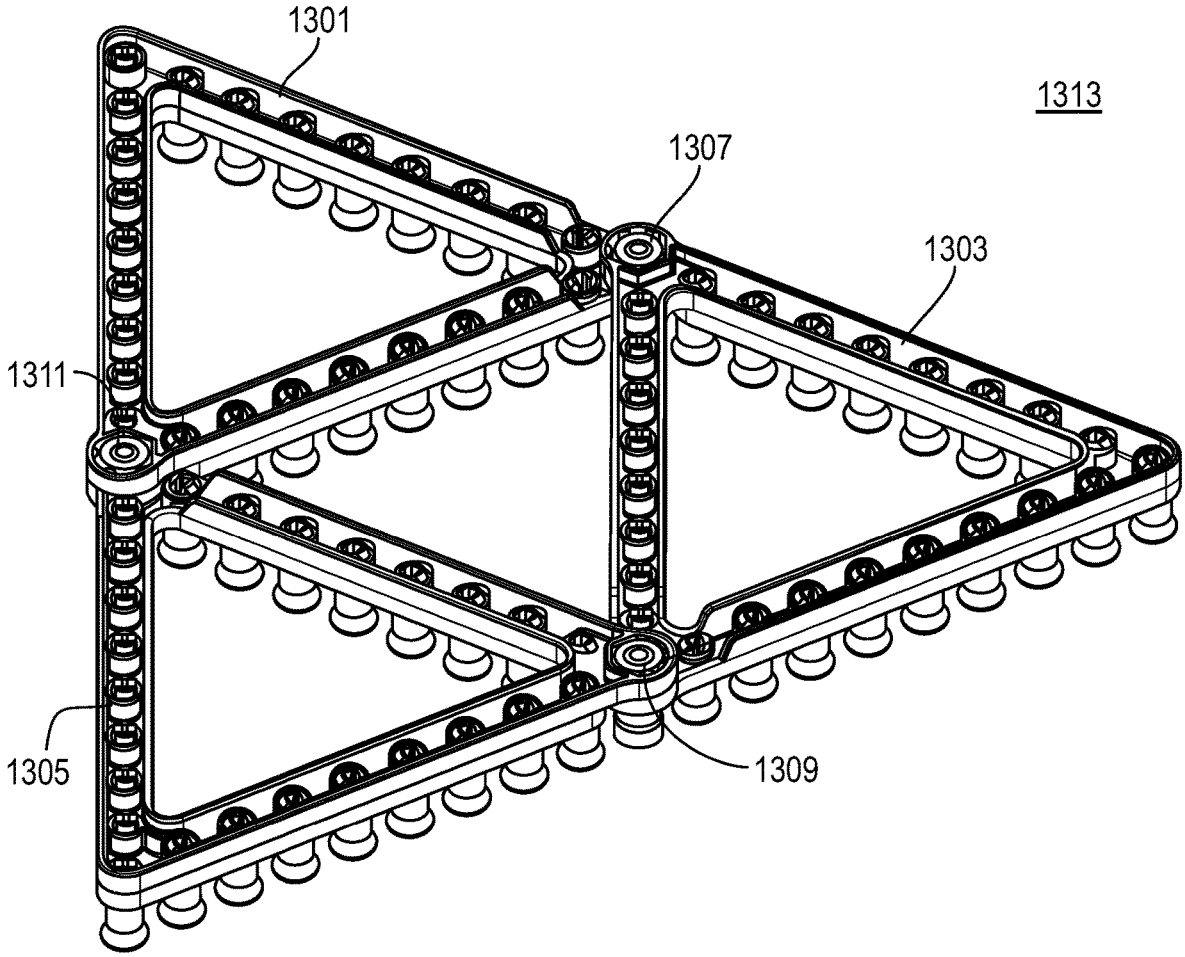
FIG. 13A is a back view of three connecting triangles creating one large triangle for string art, according to one example embodiment.

FIG. 13A is a back view of three connecting triangles creating one large triangle for string art, according to one example embodiment. In one example embodiment, three triangle-shaped structures (1301, 1303, and 1305) are attached at three different connecting points (1307, 1309, and 1311) to create one large triangle 1313.

Figure 13B:
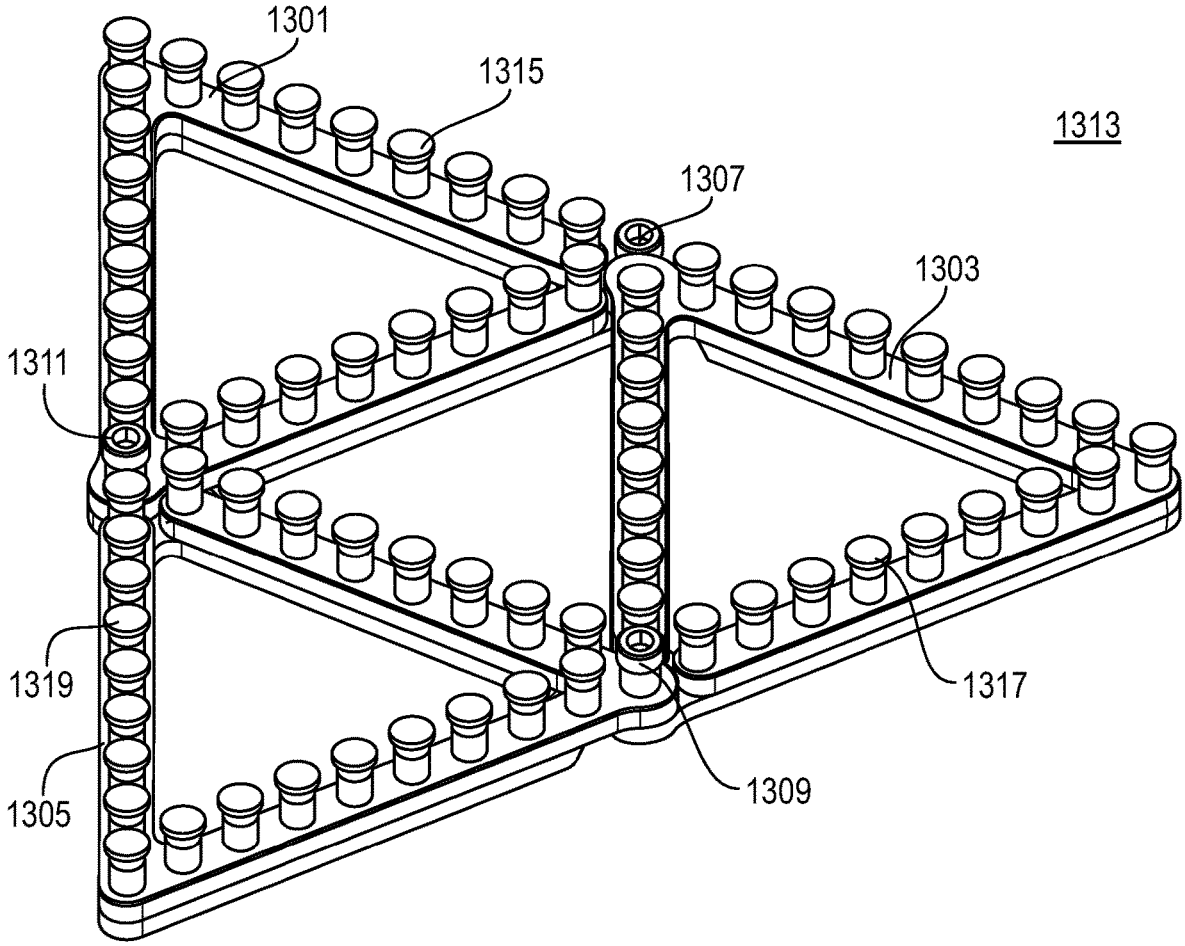
FIG. 13B is a front view of three connecting triangles creating one large triangle for string art, according to one example embodiment.

FIG. 13B is a front view of three connecting triangles creating one large triangle for string art, according to one example embodiment. As illustrated, three triangle-shaped structures (1301, 1303, and 1305) comprises of a plurality of peg-shaped members (1315, 1317, and 1319) formed to a predetermined thickness and a predetermined length. These plurality of peg-shaped members (1315, 1317, and 1319) are detachable from the plurality of holes. In another embodiment, the plurality of peg-shaped members (1315, 1317, and 1319) is in-built and fixed to their respective triangle-shaped structures (1301, 1303, and 1305). In a further embodiment, the triangle-shaped structures (1301, 1303, and 1305) may comprise both detachable and fixed peg-shaped members. As previously mentioned, the three triangle-shaped structures (1301, 1303, and 1305) are attached at three different connecting points (1307, 1309, and 1311) to create one large triangle 1313.

Figure 13C:
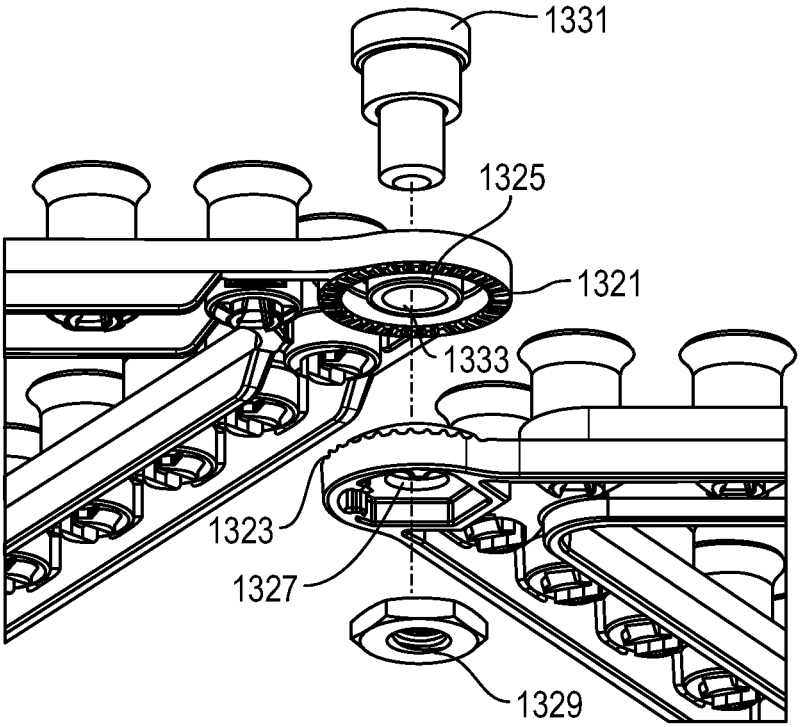
FIG. 13C illustrates the connection points of the three connecting triangles, according to one example embodiment.

FIG. 13C illustrates the connection points of the three connecting triangles, according to one example embodiment. In one embodiment, a base structure comprises one or more connectors, i.e., connection points, to receive another base structure, wherein the one or more connectors are male connectors or female connectors. The three connection points (1307, 1309, and 1311) comprises of teeth (1321 and 1323) which provide flexibility in the range of motion in terms of the angle when two connection points of the triangle-shaped structures (1301, 1303, and 1305) are connected. These teeth permit the addition of structures as long as the parts can be incorporated into the teeth. In one example embodiment, teeth 1321 of triangle-shaped structure 1301 is adjusted over teeth 1323 of triangle-shaped structure 1303. While adjusting the teeth in-built fixed screw 1325 of triangle-shaped structure 1301 is inserted in hole 1327 of triangle-shaped structure 1303. Thereafter, nut 1329 comprising of internal female threads creates a self-locking effect with screw 1325. Subsequently, a snap-in peg or a threaded peg (1331) is inserted in holes 1333 and 1327 of triangle-shaped structures 1301 and 1303 for securing the two connection points together. As a result, the connection points are securely fastened together with the teeth holding the position and the peg, nut, and screw holding the frames. In one embodiment, snap-in peg 1331 is strong and tight to secure the two connection points together while the teeth secure the positioning relative to one another. In another embodiment, the threaded peg 1331 works similarly to a snap-in peg but would secure into either a corresponding threaded hole or into a nut.

Figure 13D:
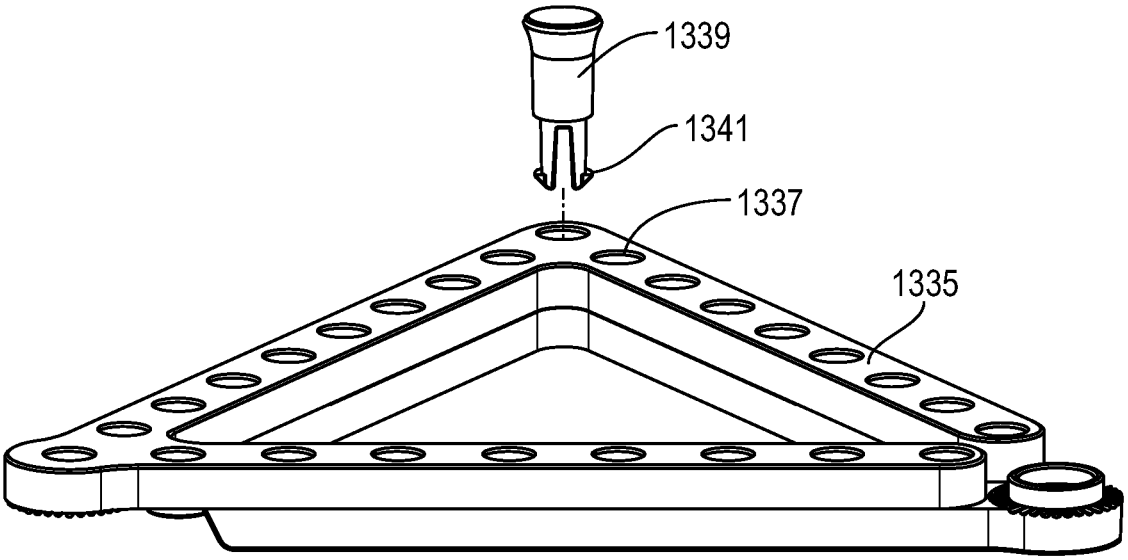
FIG. 13D is a front view of a triangular structure for string art, according to one example embodiment.
Figure 14A:
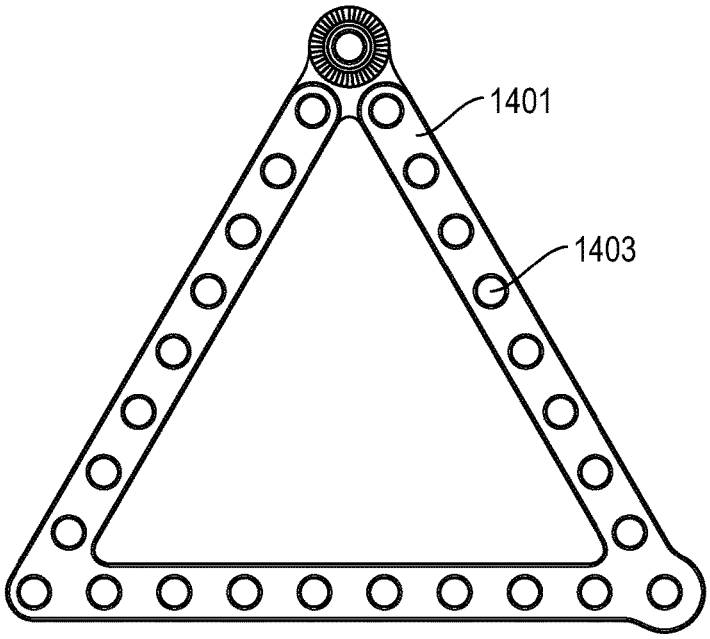
FIGS. 14 A-F illustrate various structures for string art, according to one example embodiment.
Figure 14B:
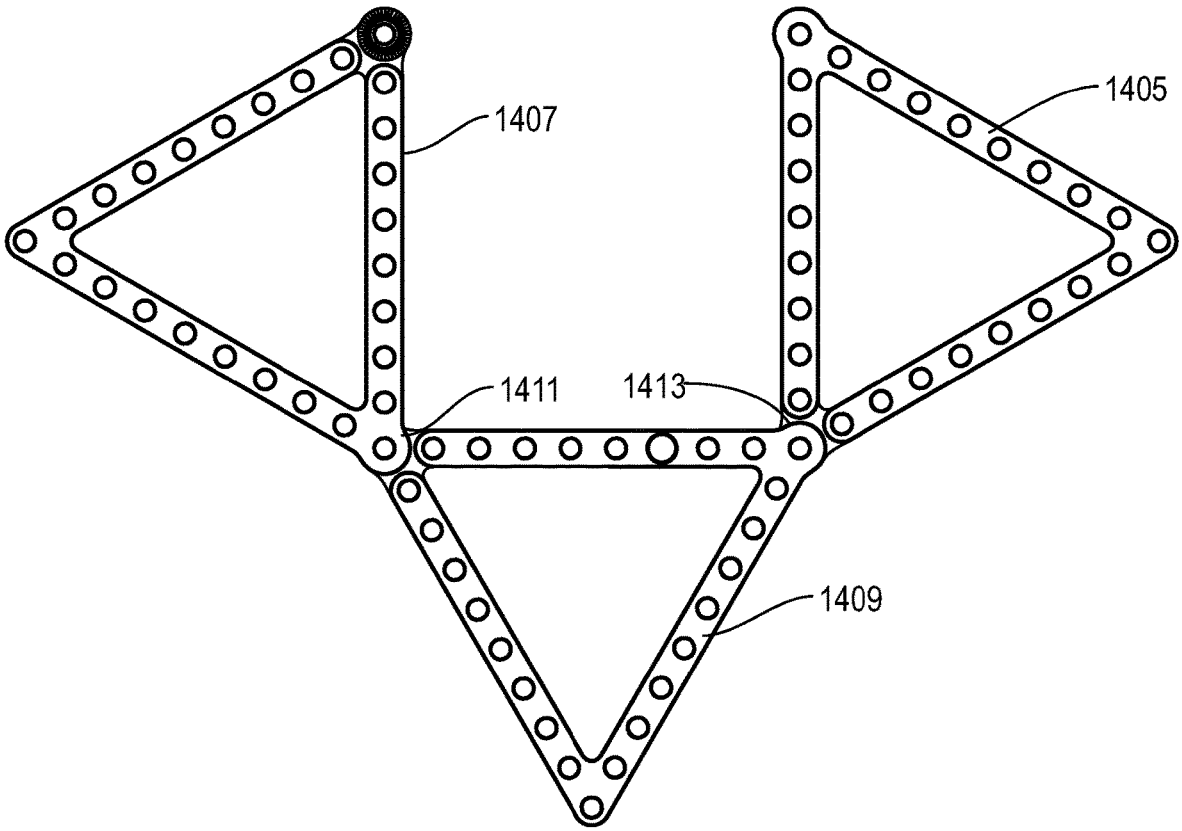
Figure 14C:
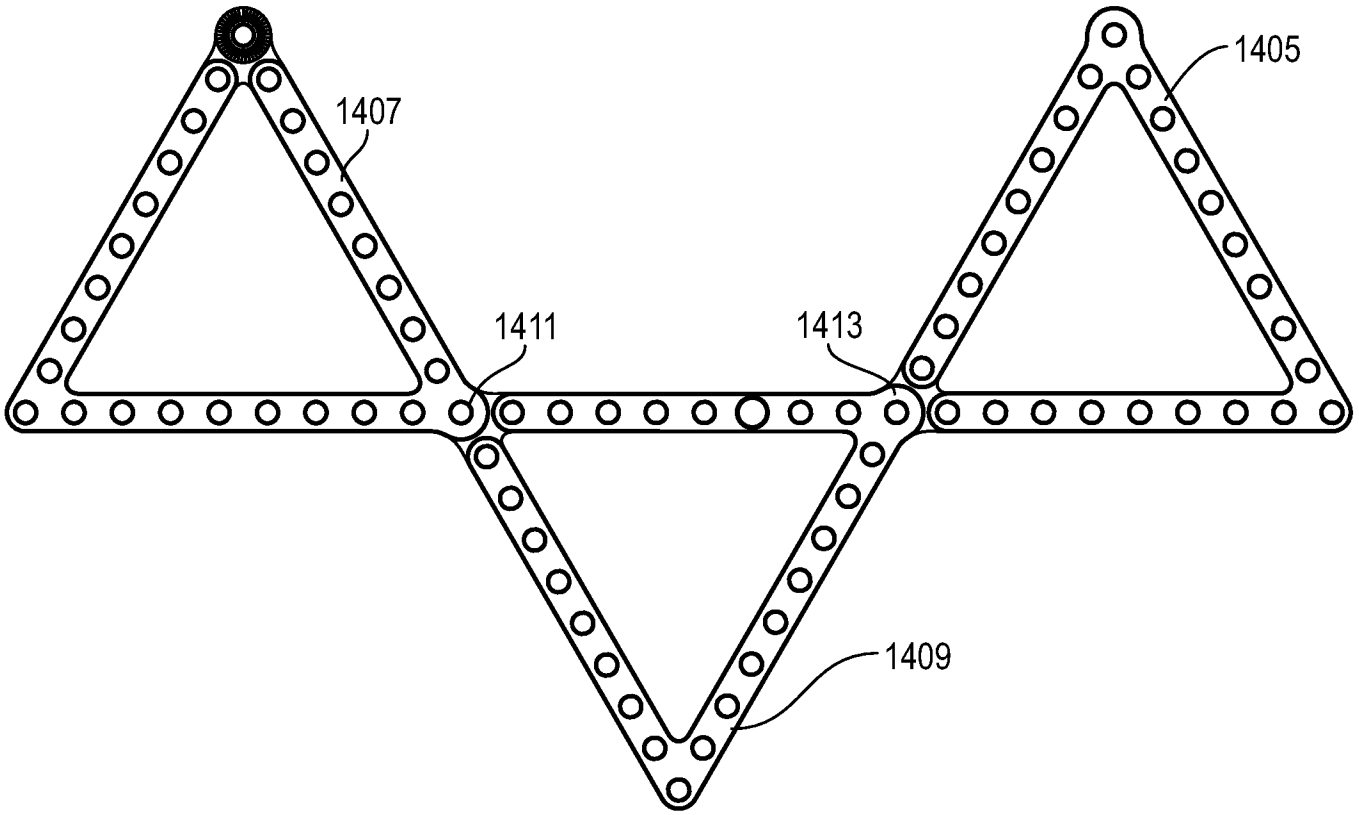
Figure 14D:
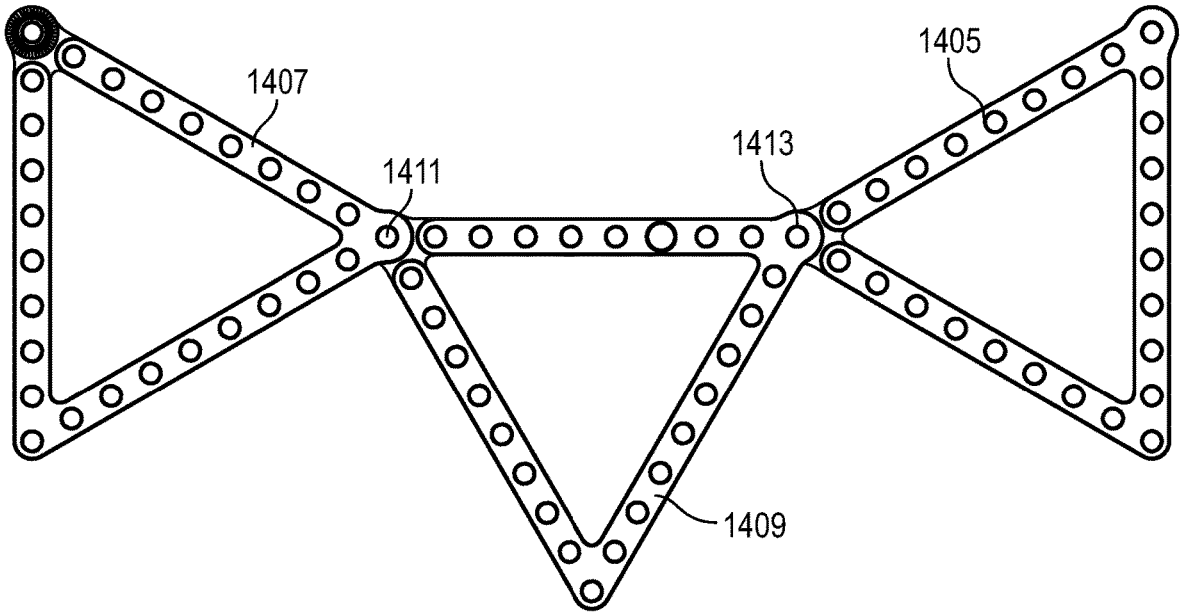
Figure 14E:
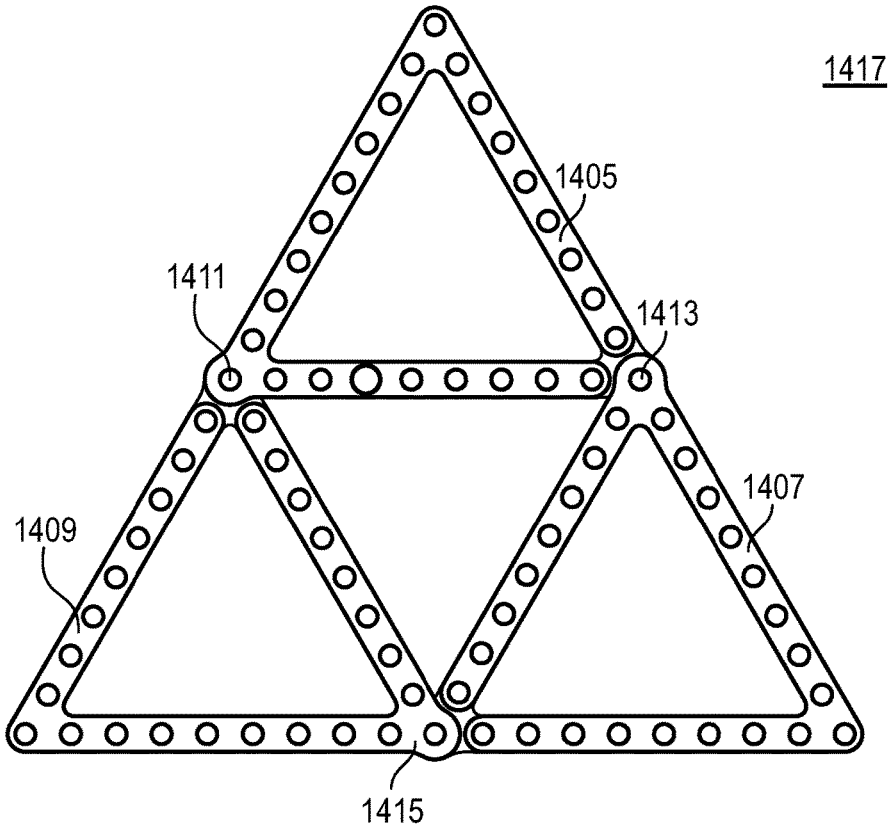
Figure 14F:
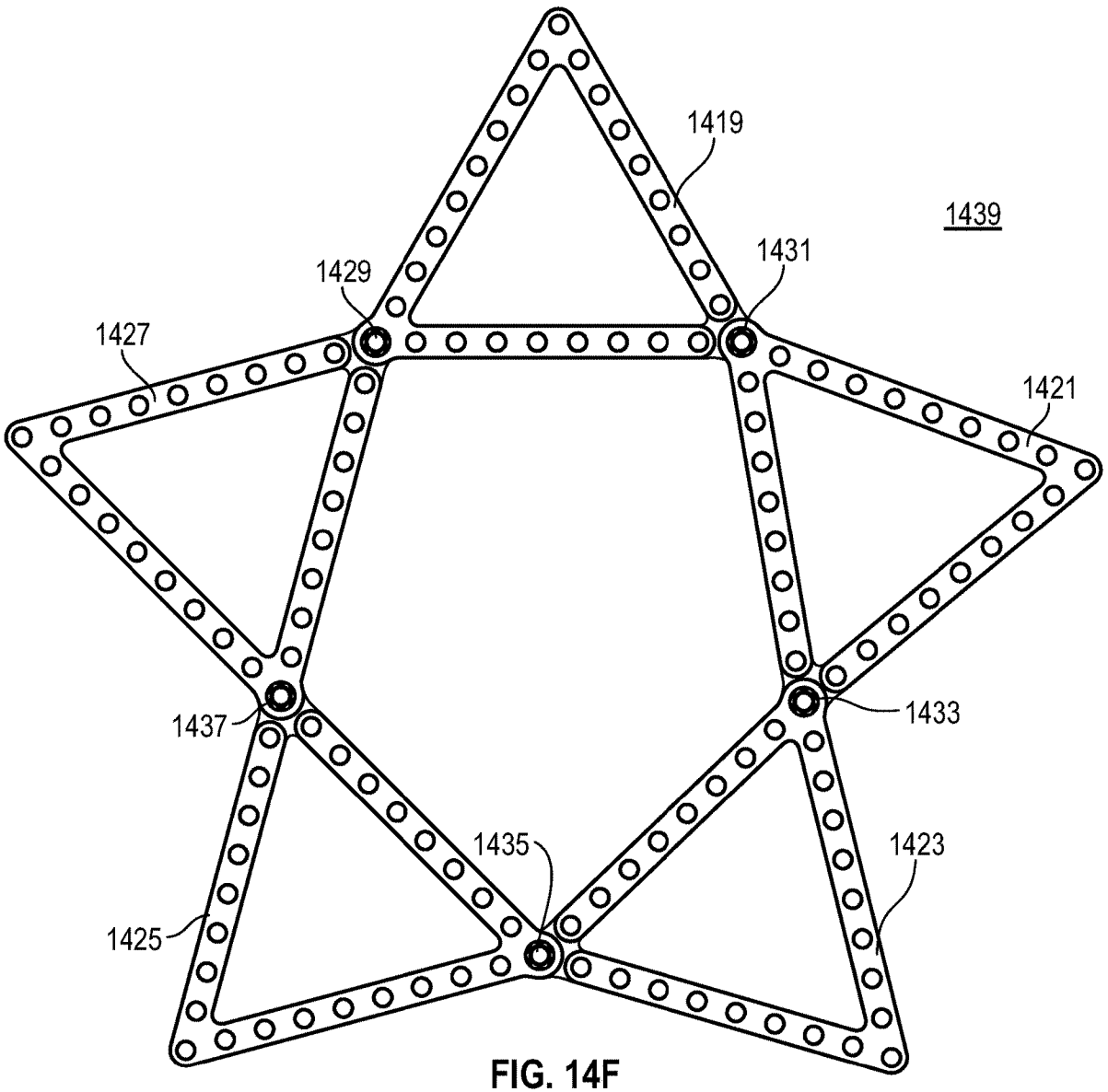
Figure 15A:
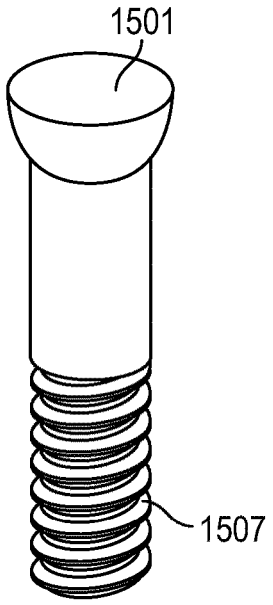
FIGS. 15 A-C illustrate a plurality of peg-shaped members with a threaded portion, according to one example embodiment.
FIG. 15D is a perspective view of a plurality of peg-shaped members with a threaded portion, according to one example embodiment.
Figure 15B:
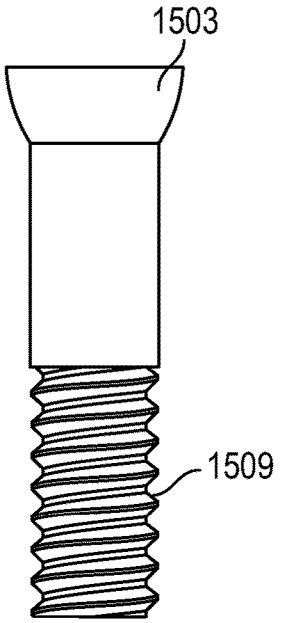
Figure 15C:
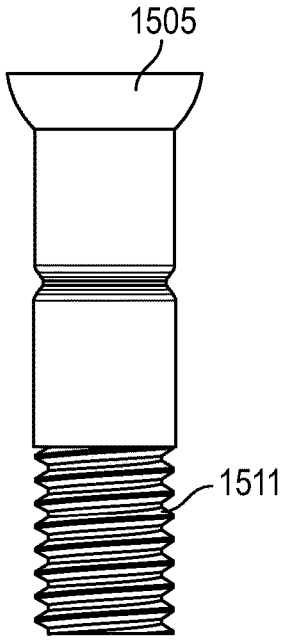
Figure 15D:
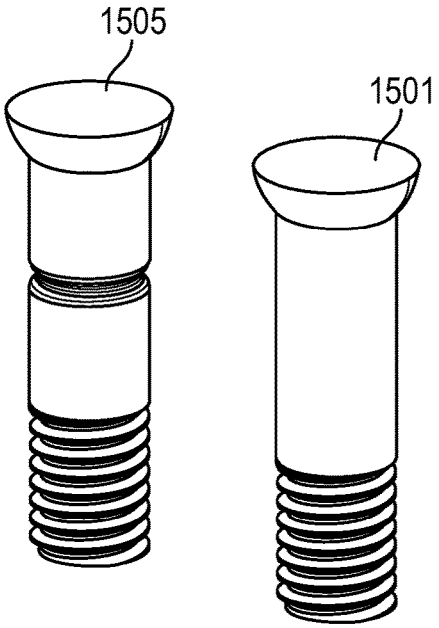

FIG. 13D is a front view of a triangular structure for string art, according to one example embodiment. In one embodiment, the upper surface of triangular-shaped structure 1335 comprises a plurality of holes 1337 to receive a plurality of peg-shaped members 1339. The plurality of holes 1337 is formed to a predetermined arrangement to achieve a predetermined design, and defines an inner diameter and inner depth to comfortably receive peg-shaped members 1339. The plurality of peg-shaped members 1339 is formed to a predetermined thickness and a predetermined length. Furthermore, the plurality of peg-shaped members 1339 comprises a split bottom portion with bent edges 1441 on the opposite direction, these bent edges secure the plurality of peg-shaped members 1339 to the plurality of holes 1337.

FIGS. 14 A-F illustrate various structures for string art, according to one example embodiment. FIG. 14A depicts a triangle-shaped structure 1401 comprising a plurality of holes 1403 formed to a predetermined arrangement to achieve a predetermined design. The plurality of holes 1403 defines an inner diameter and inner depth to comfortably receive peg-shaped members.

Adverting to FIGS. 14 B-D, three triangle-shaped structures (1405, 1407, and 1409) are connected at two different connecting points (1411 and 1413) to create different shapes for string art. This allows a level of modularity using one shape. In FIG. 14E, three triangle-shaped structures (1405, 1407, and 1409) are connected at three different connecting points (1411, 1413, and 1415) to create one large triangle (1417) for string art. In one example embodiment, the addition of a fourth triangle creates a frame that has the shape of a box with four triangular points. Referring to FIG. 14F, five connecting triangles (1419, 1421, 1423, 1425, and 1427) are connected at five different connecting points (1429, 1431, 1433, 1435, and 1437) to create a pentagon with five triangular points (1439) for string art. In such a manner, an additional structure may be attached to the existing structures to create varying shapes for string art, thereby adding more modularity.

FIGS. 15 A-C illustrate a plurality of peg-shaped members with a threaded portion, according to one example embodiment. In one embodiment, peg-shaped members 1501, 1503, and 1505 comprise of threaded portions 1507, 1509, and 1511. The threaded portions 1507, 1509, and 1511 are formed to a predetermined length based, at least in part, on attributes of the plurality of holes. These threaded portions interlock with the threaded holes in a string art frame. The height of the threaded portions 1507, 1509, and 1511 affect the height of the peg-shaped members. The different height of pegs for different layers of string art on the same frame brings another dimension and users can effectively have layers of string patterns. Referring to FIG. 15D, it is a perspective view of a plurality of peg-shaped members with a threaded portion.

Figure 16A:
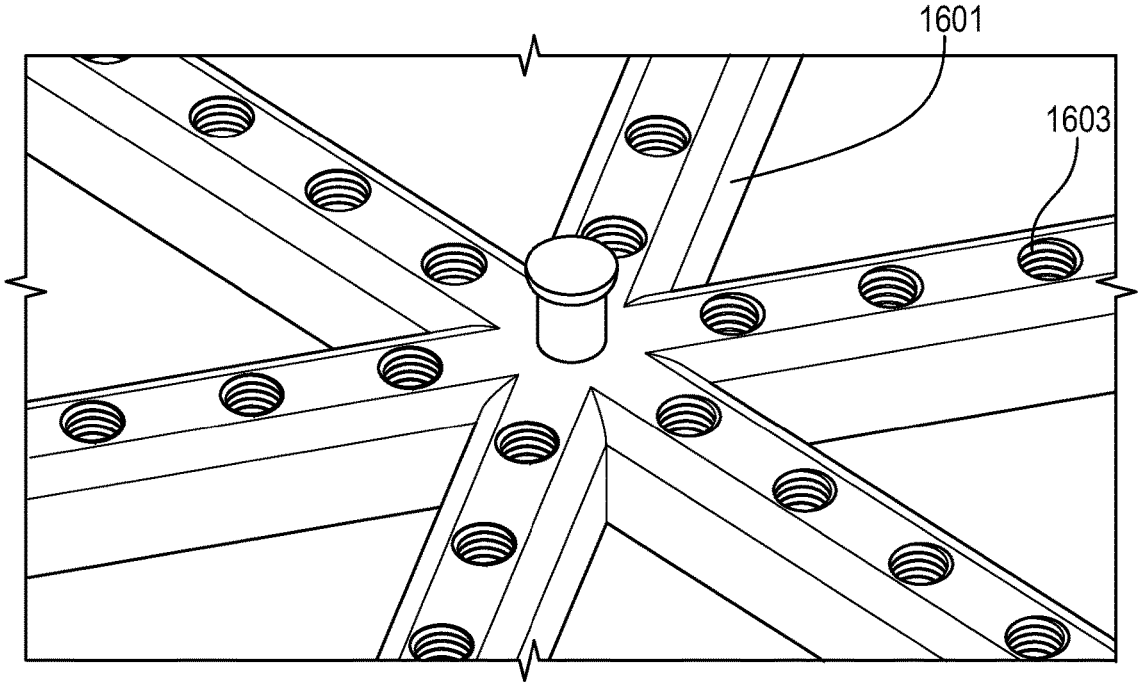
FIGS. 16 A-B illustrate an upper surface of string art structure with a plurality of threaded holes to receive a plurality of threaded peg-shaped members, according to one example embodiment.
Figure 16B:
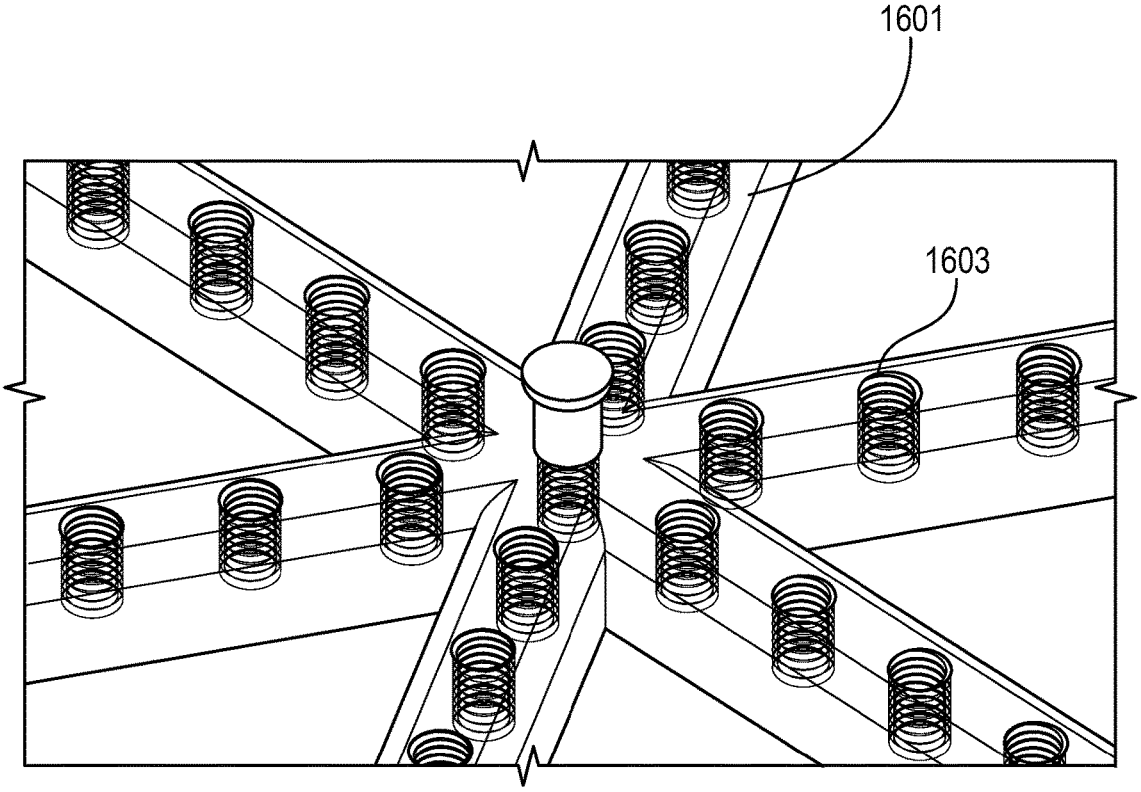

FIGS. 16 A-B illustrate an upper surface of string art structure with a plurality of threaded holes to receive a plurality of threaded peg-shaped members, according to one example embodiment. As illustrated in FIGS. 16 A-B, the upper surface of the string art structure 1601 comprises a plurality of threaded holes 1603 with an inner diameter and inner depth to comfortably receive threaded peg-shaped members 1501, 1503, and 1505. This plurality of threaded holes 1603 have uniform spacing between one another, however, the spacing may vary per requirement. In one embodiment, the plurality of holes 1603 is circular, however, the shape and size may vary per requirement.

Figure 17A:
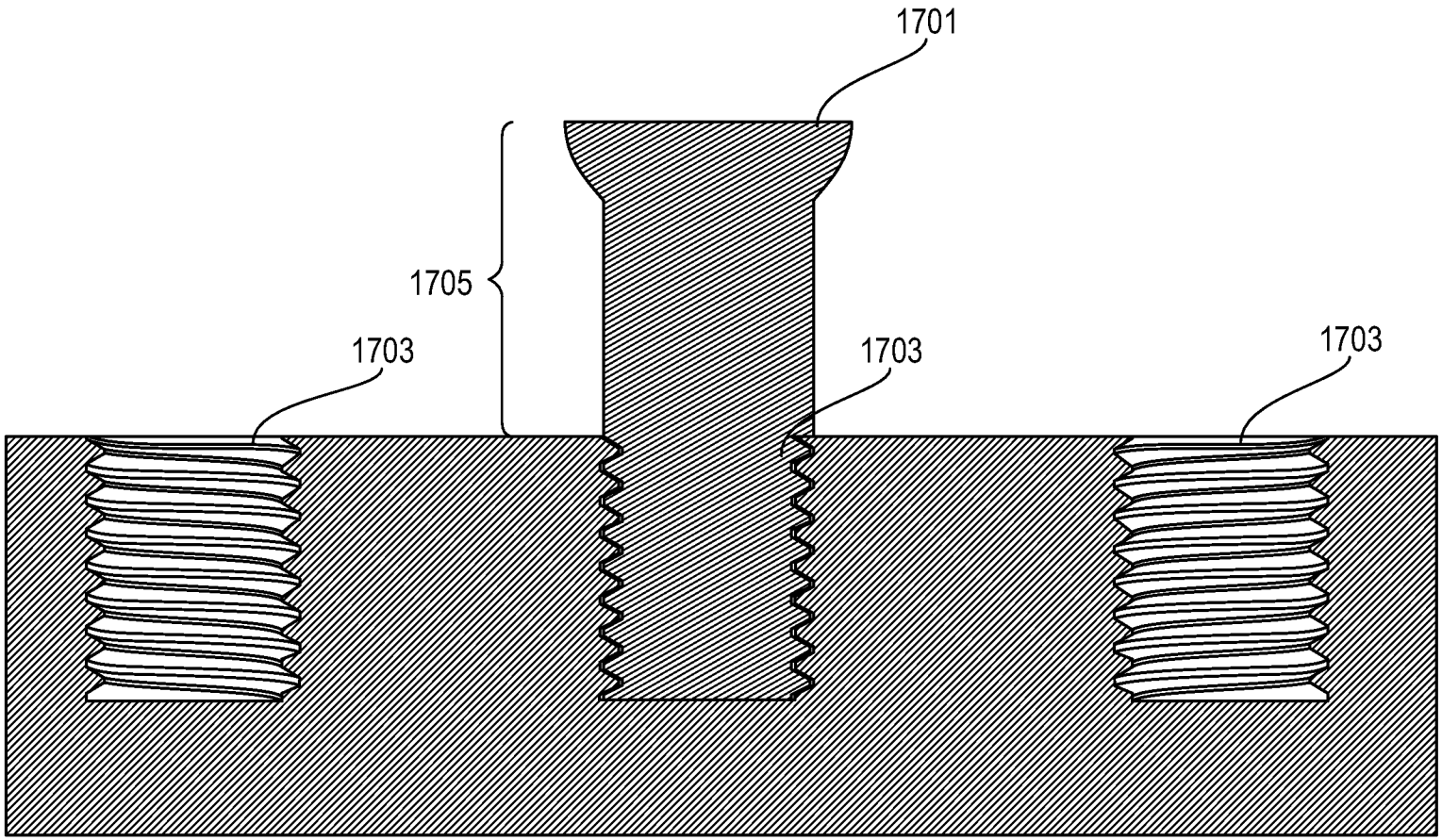
FIGS. 17 A-B illustrate a cross-sectional view of a threaded peg-shaped member engaged with a threaded hole of a string art structure, according to one example embodiment.
Figure 17B:
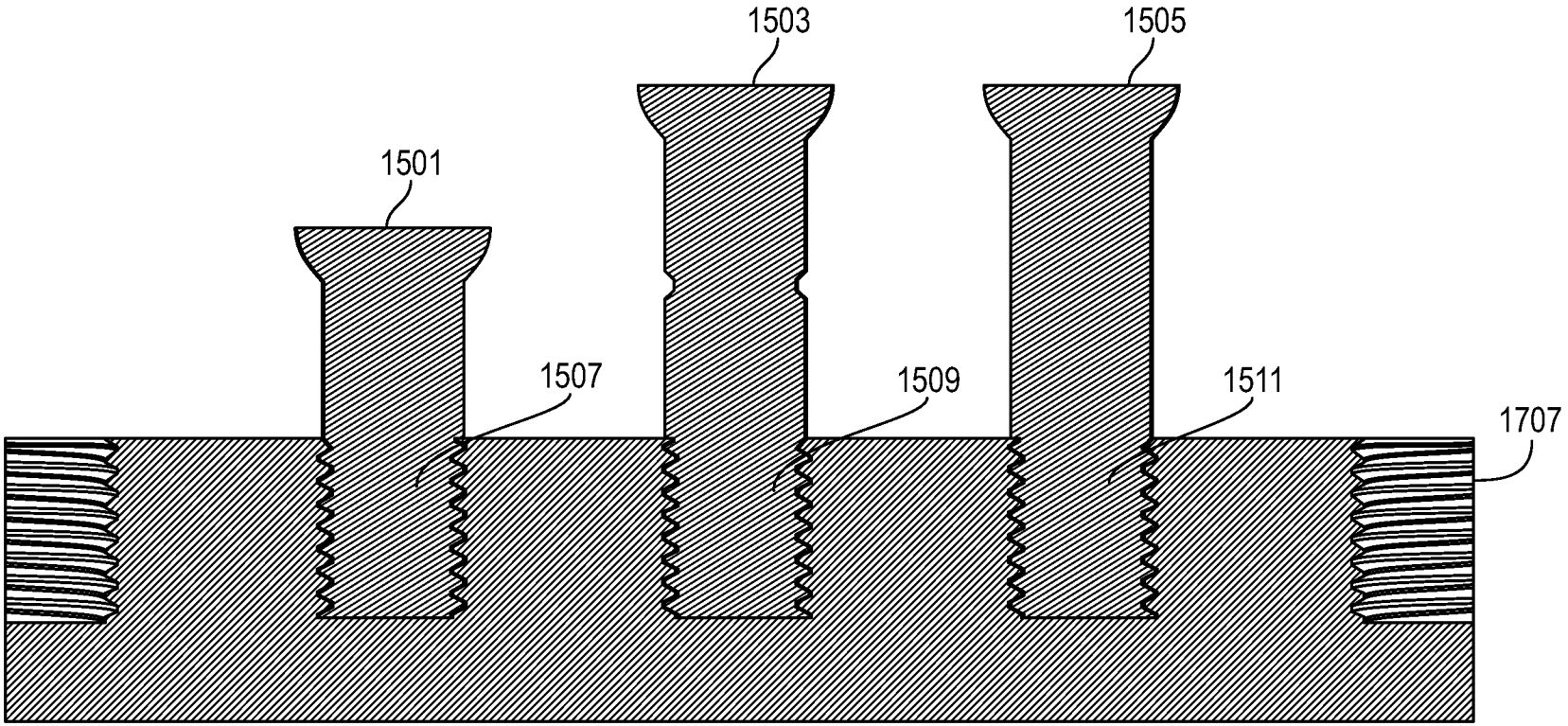
Figure 18A:
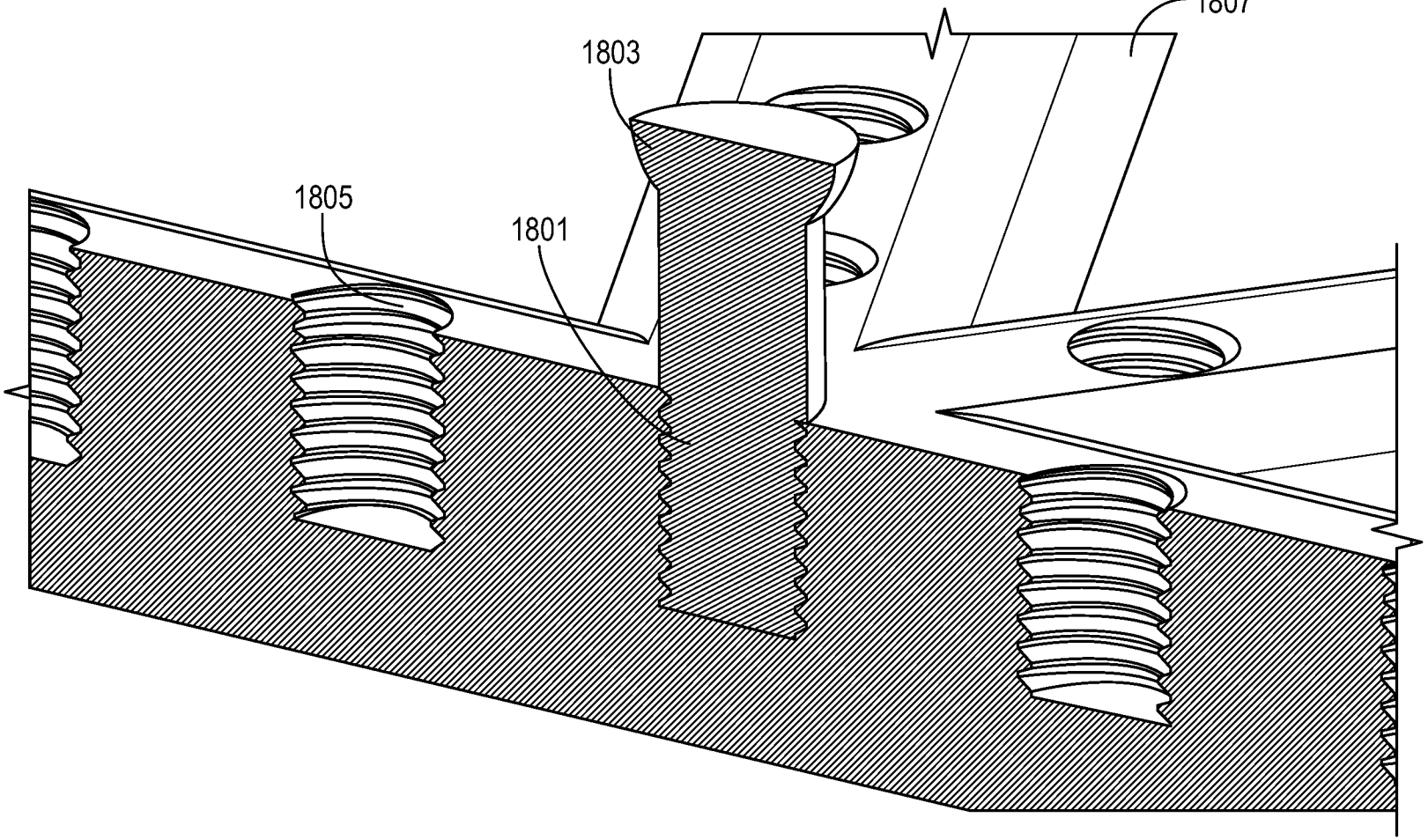
FIGS. 18 A-D illustrate an internal view of a threaded peg-shaped member engaged with a threaded hole of a string art structure, according to one example embodiment.
Figure 18B:
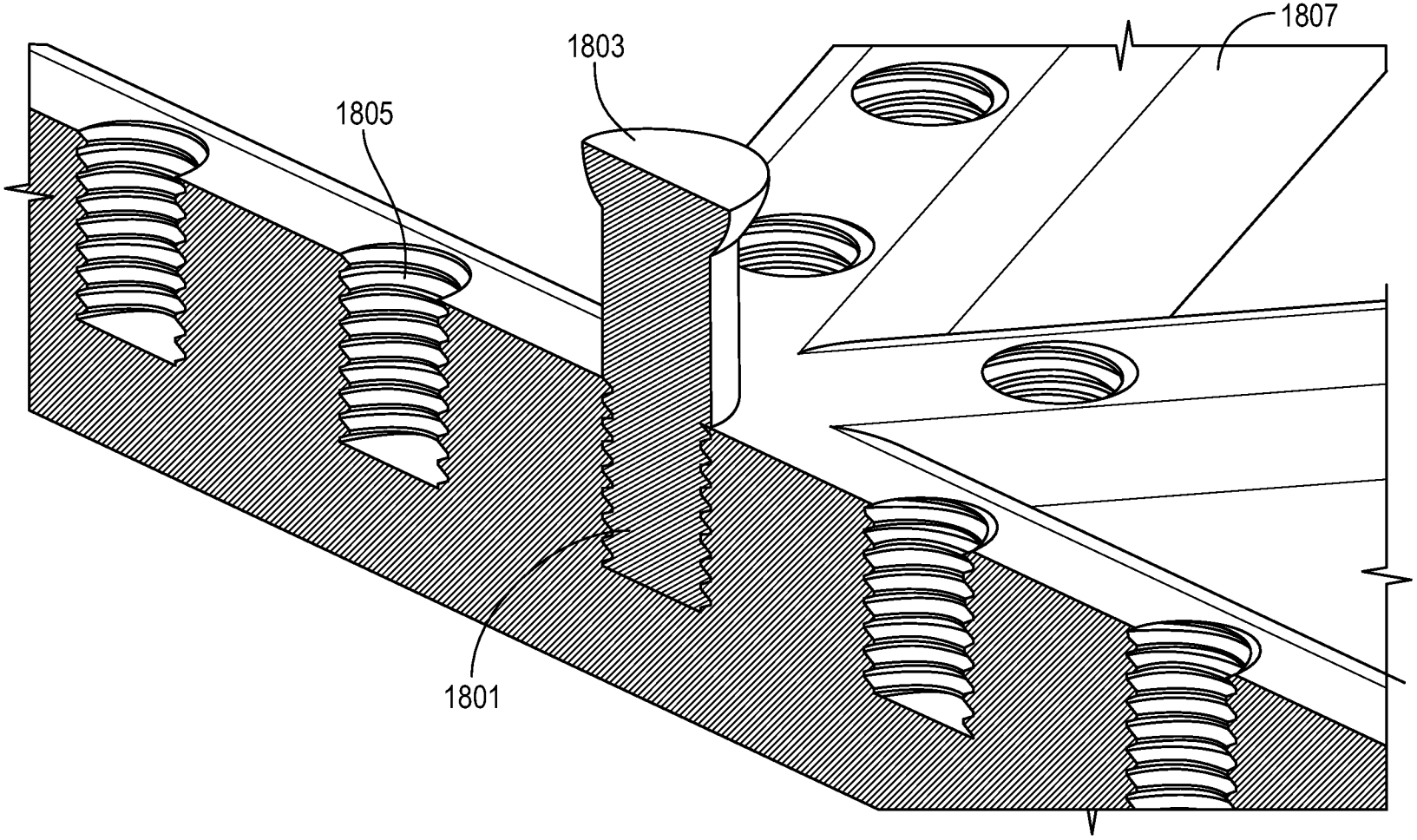
Figure 18C:
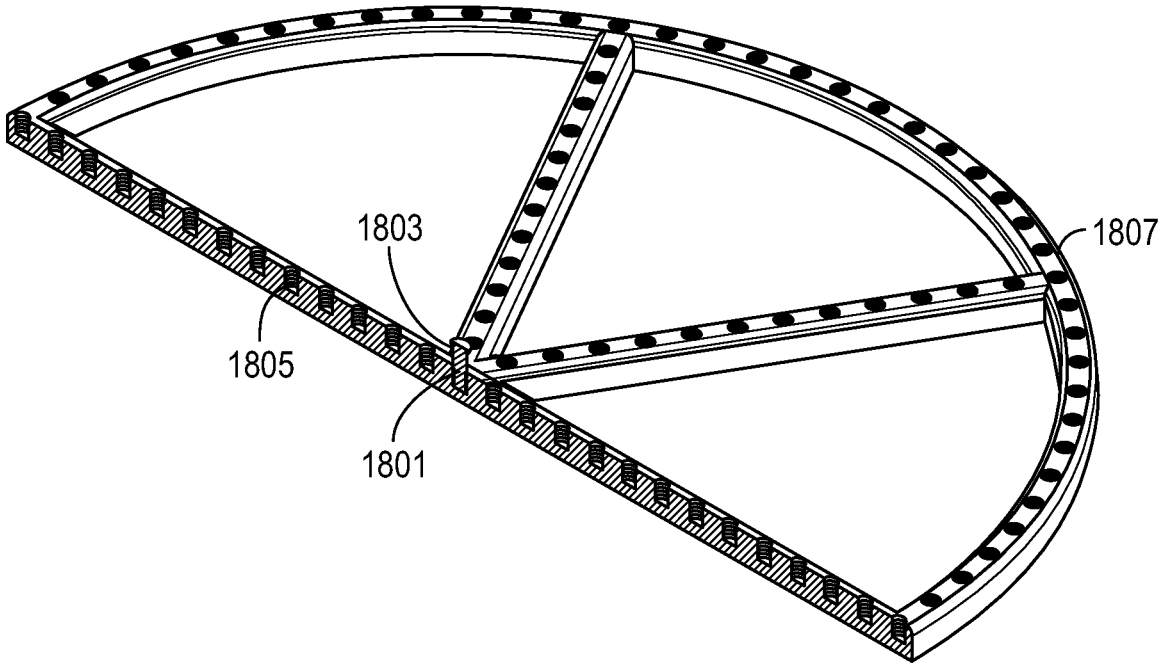
Figure 18D:
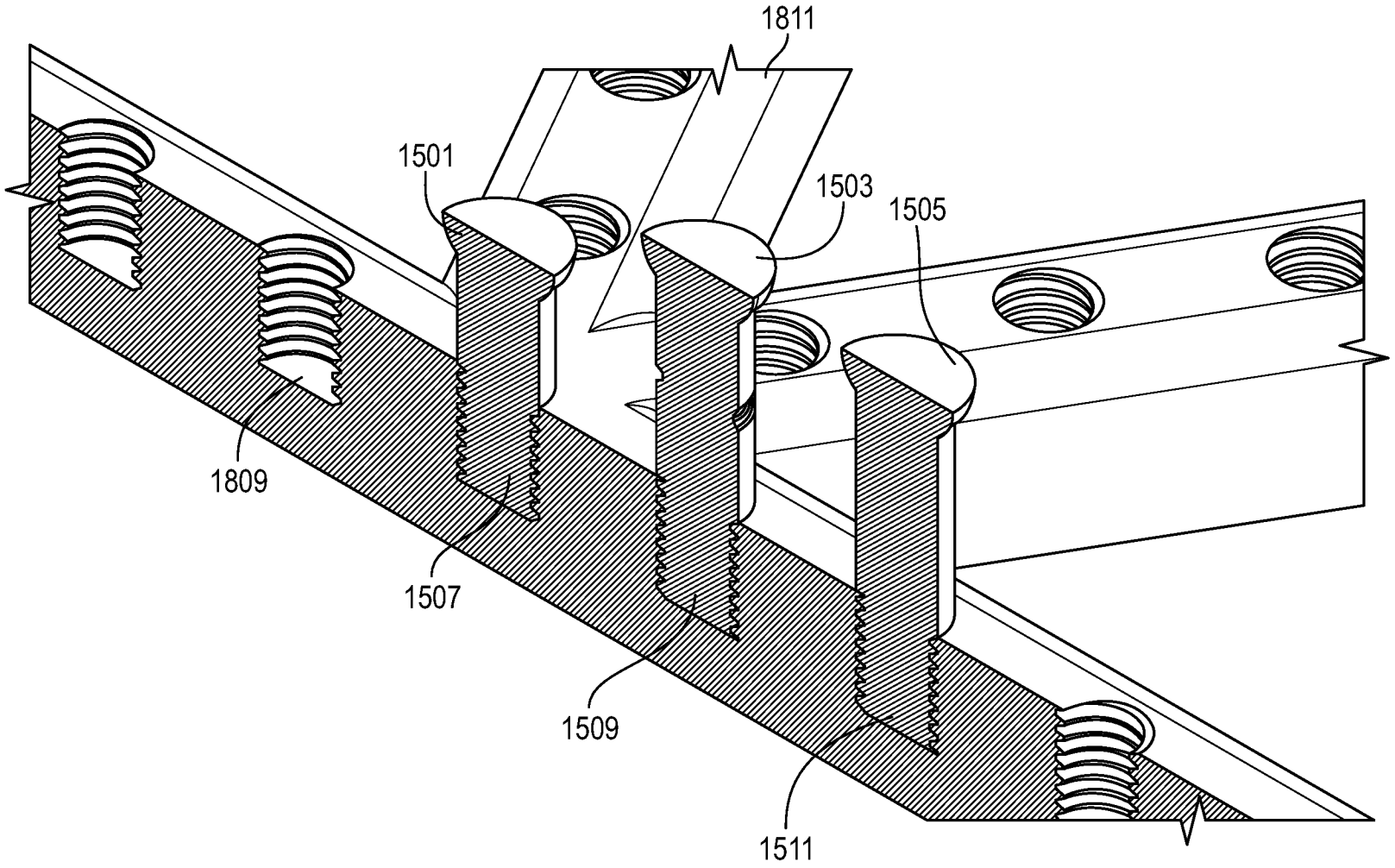

FIGS. 17 A-B illustrate a cross-sectional view of a threaded peg-shaped member engaged with a threaded hole of a string art structure, according to one example embodiment. In FIG. 17A, the threaded portion of a peg-shaped member 1701 is fully inserted into threaded hole 1703 of a string art structure, whereupon peg-shaped member 1701 has a height of 1705. In one scenario, the height of the peg-shaped member 1701 is affected by the length of the threaded portion and the depth of hole 1703. Referring to FIG. 17B, threaded portions 1507, 1509, and 1511 of peg-shaped members 1501, 1503, and 1505 are fully inserted into threaded holes 1707 of a string art structure.

FIGS. 18 A-D illustrate internal views of a threaded peg-shaped member engaged with a threaded hole of a string art structure, according to one example embodiment. FIGS. 18 A-C depict internal views of threaded portion 1801 of peg-shaped member 1803 fully inserted into threaded hole 1805 of string art structure 1807. Referring to FIG. 18D, it represents an internal view of threaded portions 1507, 1509, and 1511 of peg-shaped members 1501, 1503, and 1505 fully inserted into threaded holes 1809 of string art structure 1811.

In the preceding description, the present disclosure is described with reference to specifically exemplary embodiments thereof. It will, however, be evident that various modifications and changes may be made thereto without departing from the broader spirit and scope of the present disclosure, as set forth in the claims. The specification and drawings are, accordingly, to be regarded as illustrative and not as restrictive. It is understood that the present disclosure is capable of using various other combinations and embodiments and is capable of any changes or modifications within the scope of the inventive concept as expressed herein.

What is claimed is:

1. An apparatus for making string art, comprising:

a base structure having a surface with a plurality of protruding members arranged in a predetermined pattern that is more than a line, at least one male connector and at least one female connector to receive another base structure, wherein at least one of the plurality of protruding members has a top end with a top diameter configured to hold a string, and a middle diameter configured to insert via one of the at least one male connector and the at least one female connector of the base structure and via one of a male connector and a female connector of the another base structure.

2. The apparatus of claim 1, wherein the top end has a height above the base structure, and the height is determined based on a number of string pattern layers of the string art, and wherein the string is selectively run on a subset of the plurality of peg-shaped members to form the string pattern layers on planes in parallel with the surface of the base structure.

3. The apparatus of claim 1, wherein the at least one protruding members, the at least one male connector and at least one female connector of the base structures are engaged to provide an adjustable connecting angle of the base structures.

4. The apparatus of claim 2, wherein the base structure comprises one or more in-built slots to house one or more magnets, and wherein the base structure is interlocked with the another base structure via the one or more magnets.

5. The apparatus of claim 1, wherein the plurality of protruding members comprises a grooved shank.

6. The apparatus of claim 1, wherein the plurality of protruding members comprises markings for a string maneuver.

7. The apparatus of claim 1, wherein the base structure and the plurality of protruding members comprise of metallic materials, wooden materials, or plastic materials.

8. The apparatus of claim 1, wherein the protruding members are peg-shaped, the surface has a plurality of holes configured to receive the plurality of peg-shaped members, wherein each of the peg-shaped members has an end affixed with a fastening mechanism to secure the corresponding peg-shaped member into the associated one of the plurality of holes.

9. The apparatus of claim 1, wherein each of the at least one male connector and the at least one female connector of the base structures has an inner hole configured to receive the at least one protruding members.

10. The apparatus of claim 9, wherein each of the at least one male connector and the at least one female connector of the base structures has teeth to interlock there-between.

11. The apparatus of claim 10, wherein the teeth are arranged on a surface in parallel with the surface with the plurality of protruding members.

12. The apparatus of claim 11, wherein the surface with the teeth is ring-shaped and has a diameter bigger than the inner hole.

13. The apparatus of claim 9, wherein the inner hole is located within a built-in screw of the at least one male connector or the at least one female connector.

14. The apparatus of claim 13, wherein the apparatus further include a nut configured to engaged with the built-in screw via threads.

15. A method of making a structure for string designs comprising:

forming a base structure having a surface with a plurality of holes, at least one male connector and at least one female connector to receive another base structure, wherein the plurality of holes is arranged according to a predetermined pattern that is more than a line; and inserting a plurality of peg-shaped members within the plurality of holes, wherein each of the peg-shaped members has an end affixed with a fastening mechanism to secure the corresponding peg-shaped member into the associated one of the plurality of holes, and wherein at least one of the plurality of peg-shaped members has a top end with a top diameter configured to hold a string, and a middle diameter configured to insert via one of the at least one male connector and the at least one female connector of the base structure and via one of a male connector and a female connector of the another base structure.

16. A method of claim 15, further comprising:

forming the another base structure having another plurality of peg-shaped members, the male connector and the female connector, wherein the top end has a height above the base structure, and the height is determined based on a number of string pattern layers of the string art, and wherein a string is selectively run on a subset of the plurality of peg-shaped members to form a string pattern on a plane in parallel with the surface of the base structure.

17. A method of claim 16, wherein the fastening mechanism permits the corresponding peg-shaped member to detach from the base structure, and wherein the string pattern is provided with the base structure as an output.

18. The method of claim 15, wherein the at least one peg-shaped members, the at least one male connector and at least one female connector of the base structures are engaged to provide an adjustable connecting angle of the base structures.

19. The method of claim 18, wherein the base structure comprises one or more in-built slots to house one or more magnets, and wherein the base structure is interlocked with the another base structure via the one or more magnets.

20. The method of claim 15, wherein plurality of peg-shaped members comprises a grooved shank.

* * * * *